US009430977B2

(12) United States Patent
Ooga

(10) Patent No.: US 9,430,977 B2
(45) Date of Patent: Aug. 30, 2016

(54) VIDEO SIGNAL PROCESSING CIRCUIT, VIDEO DISPLAY DEVICE, AND VIDEO SIGNAL PROCESSING METHOD

(71) Applicant: NLT Technologies, Ltd., Kanagawa (JP)

(72) Inventor: Kouichi Ooga, Kanagawa (JP)

(73) Assignee: NLT TECHNOLOGIES, LTD., Kanagawa (JP)

( * ) Notice: Subject to any disclaimer, the term of this patent is extended or adjusted under 35 U.S.C. 154(b) by 105 days.

(21) Appl. No.: 14/454,072

(22) Filed: Aug. 7, 2014

(65) Prior Publication Data

US 2015/0042696 A1 Feb. 12, 2015

(30) Foreign Application Priority Data

Aug. 7, 2013 (JP) ..... 2013-164213

(51) Int. Cl.
*G09G 3/36* (2006.01)
*G09G 3/34* (2006.01)

(52) U.S. Cl.
CPC ..... *G09G 3/3611* (2013.01); *G09G 3/3406* (2013.01); *G09G 2320/0626* (2013.01); *G09G 2320/0673* (2013.01); *G09G 2360/16* (2013.01)

(58) Field of Classification Search
None
See application file for complete search history.

(56) References Cited

U.S. PATENT DOCUMENTS 6,160,532 A * 12/2000 Kaburagi ..... G06F 3/1475 345/87
2007/0229712 A1* 10/2007 Uota ..... G09G 3/20 348/674
2009/0303264 A1* 12/2009 Toshima ..... G09G 3/3406 345/690
2010/0002018 A1* 1/2010 Hirata ..... G09G 5/028 345/690
2010/0245405 A1* 9/2010 Murai ..... G09G 3/3406 345/690
2010/0254623 A1* 10/2010 Yu ..... G06T 5/009 382/274

FOREIGN PATENT DOCUMENTS

JP 2005-249891 9/2005
JP 2007-310097 11/2007
WO 2008-117784 10/2008
WO 2009-081602 7/2009

* cited by examiner

*Primary Examiner* — Dwayne Bost
*Assistant Examiner* — Christopher Kohlman
(74) *Attorney, Agent, or Firm* — Young & Thompson

(57) ABSTRACT

The video signal processing circuit which analyzes video signals inputted from outside, performs conversion processing for image quality adjustment on the video signals based on a result of analysis, transmits those towards a video display unit includes: a feature value/maximum value calculation module which calculates a feature value that is a numerical value showing a degree of brightness of the video signals; a gradation conversion threshold value calculation module which calculates a threshold value regarding conversion of the gradation based on a threshold value calculation expression that is formed based on the feature value and a conversion coefficient set in advance; and a gradation conversion module which performs gradation conversion based on a linear function that increases linearly by taking a region of the gradation equal to or higher than the threshold value among the video signals as a target.

19 Claims, 9 Drawing Sheets

VIDEO SIGNAL PROCESSING CIRCUIT, VIDEO DISPLAY DEVICE, AND VIDEO SIGNAL PROCESSING METHOD

CROSS-REFERENCE TO RELATED APPLICATION

This application is based upon and claims the benefit of priority from Japanese patent application No. 2013-164213, filed on Aug. 7, 2013, the disclosure of which is incorporated herein in its entirety by reference.

BACKGROUND OF THE INVENTION

1. Field of the Invention

The present invention relates to a processing technique regarding video signals. More specifically, the present invention relates to a video signal processing circuit, a video display device, and a video signal processing method for executing conversion processing on video signals inputted from outside.

2. Description of the Related Art

In display devices whose thickness has been reduced more and more in accordance with the recent technical innovation, it is being tried to lower the power consumption by employing LED for the backlight (B/L), for example. However, even with the thin-type display device employing the LED and the like, the proportion of the power consumed by the backlight among the total power consumption is still large. Therefore, the techniques and the like for achieving low power consumption by controlling the luminance of the backlight in accordance with the video signals are being continuously studied and developed.

When trying to reduce the power consumption of the entire thin-type display device, a large effect cannot be acquired unless not only the power consumption of the backlight but also the power consumption of the circuits (IC: Integrated Circuits) for driving and controlling the backlight is reduced as well. That is, even when the power consumption of the backlight is reduced, the reduced effect of the entire device is lightened unless the reduction of the power consumption of the drive and control circuits is done at the same time. Thus, low power consumption of the drive and control circuits is also an important factor for acquiring a more significant reduction effect.

In the technical field of the liquid crystal display devices and the like used while the backlight is lighted up at all times, there is known a method which controls the luminance of the backlight in accordance with the inputted video signals. As an example of such method, there is a method which decreases the luminance of the backlight and performs corresponding gamma correction at the same time when a video that seems dark as a whole is inputted, for example. Thereby, the influence imposed upon the visibility of the displayed image is reduced, and the power consumption of the backlight is decreased.

Such method is also called CABC (Content Adaptive Brightness Control) (generally referred to as CABC hereinafter). More specifically, it is the technical content which achieves the low power consumption of the backlight through increasing the decrease amount of the luminance of the backlight (luminance decrease amount) and increasing the gradation conversion amount (degree of converting low gradation to high gradation) to increase the transmittance of the panel when the inputted video signals are constituted with dark gradations (low gradations) as a whole.

Further, when the inputted video signals are constituted with bright gradations (high gradations) as a whole, employed in CABC is a method which keeps the visibility of the original displayed image to be inputted through decreasing the luminance decrease amount as well as the gradation conversion amount.

When video signals of low gradation as a whole, for example, are inputted to a control circuit (CABC control circuit) which employs CABC and it is judged inside the circuit that the luminance decrease amount is 50%, it is ideal if it is possible to deal with such case with the processing which increase the transmittance to twice as high by executing gradation conversion.

However, when there is a part of region with a high gradation (high gradation region) even in a case where the gradation of the inputted video signals is low as a whole, gradation expression of the high gradation region cannot be achieved due to gradation collapse (phenomenon where the gradations of the high gradation region are all converted to the maximum gradation by the gradation conversion to be in the same gradation) and the like.

The gradation collapse causes striking image quality deterioration in the inputted original video signals. Thus, when a high gradation region is contained in a part of the video signals of low gradation as a whole, it is necessary to have a gradation difference at least between the high gradation region and other low gradation regions.

Therefore, in order to suppress the image quality deterioration and to increase the luminance decrease amount of the backlight still more in the CABC control circuit, it is necessary to determine in advance a threshold value (border point) for setting the border for the video signals, to divide the gradation at least to two or more regions based on the threshold value, and to execute gradation conversion suited for each of the regions.

That is, it is required to section the regions for converting the gradation into two or more based on the threshold value, to perform the gradation conversion corresponding to the luminance decrease amount up to the region of the threshold value and to perform not the gradation conversion corresponding to the luminance decrease amount but the gradation conversion by another method determined in advance after the gradation of the threshold value.

As a method for achieving such gradual gradation conversion, there is known a method which stores gradation conversion information by using LUT (lookup table), for example, in a memory in advance and outputs a single gradation corresponding to the inputted gradation by referring to the LUT (e.g., Japanese Patent Application Publication 2008-117784 (Patent Document 1) or Japanese Patent Application Publication 2009-081602 (Patent Document 2)).

In Patent Document 1, disclosed is a technical content in which each structure within a mobile phone terminal having various kinds of tables that store values and the like for correcting the luminance level of the backlight performs luminance setting and gamma correction of the backlight by referring to those tables.

In Patent Document 2, disclosed is a method which reduces the power consumption of the backlight by decreasing the luminance of the backlight and increasing the transmittance of the liquid crystal panel through performing gradation conversion. Disclosed therein is a technical content in which gradation conversion is performed by applying a constant gain (amplification rate) when the gradation is smaller than the border gradation set in advance and gradation conversion is performed by applying a gain that is decreased as the gradation is larger when the gradation is larger than the border gradation, Further, as the technical document which discloses gradation conversion executed based on numerical expressions defined in advance, following Japanese Unexamined Patent Publication 2007-310097 (Patent Document 3) or Japanese Unexamined Patent Publication 2005-249891 (Patent Document 4) is known, for example.

In Patent Document 3, disclosed is a display device which executes a correction calculation for generating output gradation data from input gradation data of a target frame image not based on the LUT described above but based on a calculation expression. Disclosed therein is a technical content in which a plurality of correction point data corresponding to different gamma values are calculated and gamma correction is executed by using the calculated data.

In Patent Document 4, disclosed is a method which decreases the luminance of the backlight and increases the transmittance of the panel by gradation conversion to keep the contrast visibility of the liquid crystal display. This method performs correction by executing gradation conversion corresponding to an ideal gamma curve (γ curve). More specifically, it is a technical content in which the decrease rate of the backlight luminance is determined based on the maximum gradation value called the peak luminance or the average value of the gradation to make it close to the ideal gamma curve.

However, with the above-described CABC, the difference between the originally inputted video signal and the video signals on which the conversion processing is done becomes significant when the luminance decrease amount and the gradation conversion amount are increased. This causes deterioration in the image quality.

Further, when the luminance change amount changes, the gradation conversion amount also changes accordingly. Thus, it is required with the conventional CABC control circuit to have an LUT of the resolution of the luminance change amount in advance, so that the circuit scale becomes massive. In addition, the contents disclosed in Patent Documents 1 and 2 described above are the techniques designed on assumption that an LUT is used. Thus, there is also an issue with those techniques that the circuit scale is increased.

With the display device disclosed in Patent Document 2 in particular, the gain is decreased when a gradation larger than the border gradation is inputted. Thus, in a case where there are a plurality of pixel regions with high gradation in a part of an image that is dark as a whole and the gradations of each pixel in the high gradation part are close to each other, the gradation difference between each of those pixels becomes small. This causes gradation collapse and a sense of discomfort in the image quality.

Further, the gradation conversion calculation expression disclosed in Patent Document 3 is in a structure which picks up only the data of some specific points from an ideal gamma curve and executes approximation. Thus, errors thereof become large, so that the image quality deterioration in the low gradation region in particular becomes conspicuous.

Further, with the method disclosed in Patent Document 4, the gradation conversion amount called a gain is standardized only to a single expression that is reciprocal to the luminance level. Moreover, the disclosure therein simply shows on a graph that the gain is reciprocal to the luminance level, and there is no depiction regarding specific gradation conversion numerical expressions and the like. That is, there is no disclosure mentioned for overcoming the issues such as the image quality deterioration caused due to the above-described gradation collapse and the like.

It is an exemplary object of the present invention to improve the inconveniences of the above described related techniques. More specifically, it is an exemplary object of the present invention to provide a video signal processing circuit, a video display device, and a video signal processing method, which can achieve suppression of the image quality deterioration and low power consumption with a small circuit scale when performing the conversion processing on the video signals.

SUMMARY OF THE INVENTION

In order to achieve the foregoing object, the video signal processing circuit according to an exemplary aspect of the invention is a video signal processing circuit which analyzes video signals inputted from outside, performs conversion processing for image quality adjustment on the video signals based on a result of analysis, transmits the video signals towards a video display unit, and generates and transmits drive control signals regarding a backlight which lights up the video display unit from a back face, and the video signal processing circuit employs a structure which includes: a feature value calculation unit which calculates a feature value that is a numerical value showing a degree of brightness of the video signals; and a gradation conversion processing unit which executes conversion processing of gradation of the video signals based on the feature value and a threshold value that is specified by the feature value, wherein the gradation conversion processing unit includes: a gradation conversion threshold value calculation module which calculates the threshold value based on a threshold value calculation expression that is formed based on the feature value and a conversion coefficient set in advance; and a gradation conversion module which performs gradation conversion based on a linear function that increases linearly by taking a region of the gradation equal to or higher than the threshold value among the video signals as a target.

Further, the video display device according to another exemplary aspect of the invention employs a structure which includes: a video display unit which displays a video towards outside; a backlight which lights up the video display unit from a back face; and a video signal processing circuit which analyzes video signals inputted from outside, performs conversion processing for adjusting image quality on the video signals based on a result of analysis, sends out the video signals towards the video display unit, and generates and transmits a drive control signal regarding the backlight which lights up the video display unit from the back face.

Further, the video signal processing method according to still another exemplary aspect of the invention is used in a video signal processing circuit which includes a gradation conversion processing unit which analyzes video signals inputted from outside, performs conversion processing for image quality adjustment on the video signals based on a result of analysis, transmits the video signals towards a video display unit, and a luminance control circuit unit which generates and transmits drive control signals regarding a backlight which lights up the video display unit from a back face, and the method includes: calculating a feature value that is a numerical value showing a degree of brightness of the video signals by the luminance control circuit unit; calculating a threshold value regarding conversion of the gradation by the gradation conversion processing unit based on a threshold value calculation expression that is formed based on the feature value and a conversion coefficient set in advance; judging whether or not the gradation of the video signals is equal to or higher than the threshold value by the gradation conversion processing unit; and executing gradation conversion based on a linear function that increases linearly on the video signals by the gradation conversion processing unit when judged that the gradation of the video signals is equal to or higher than the threshold value.

Furthermore, the video signal processing program according to still another exemplary aspect of the invention is used in a video signal processing circuit which analyzes video signals inputted from outside, performs conversion processing for image quality adjustment on the video signals based on a result of analysis, transmits the video signal towards a video display unit, and generates and transmits drive control signals regarding a backlight which lights up the video display unit from a back face, and the program causes a computer provided in advance to the video signal processing circuit to function as: a feature value calculation module which calculates a feature value that is a numerical value showing a degree of brightness of the video signals; a gradation conversion threshold value calculation module which calculates a threshold value regarding conversion of the gradation based on a threshold value calculation expression that is formed based on the feature value and a conversion coefficient set in advance; a gradation judging module which judges whether or not the gradation of the video signals is equal to or higher than the threshold value; and a linear gradation conversion module which performs gradation conversion based on a linear function that increases linearly on the video signals when judged by the gradation judging module that the gradation is equal to or higher than the threshold value.

DETAILED DESCRIPTION OF THE PREFERRED EMBODIMENTS

First Exemplary Embodiment

A first exemplary embodiment of a video signal processing circuit and a video display device according to the present invention will be described by referring to FIG. 1 to FIG. 5.

(Basic Structures)

Figure 3:
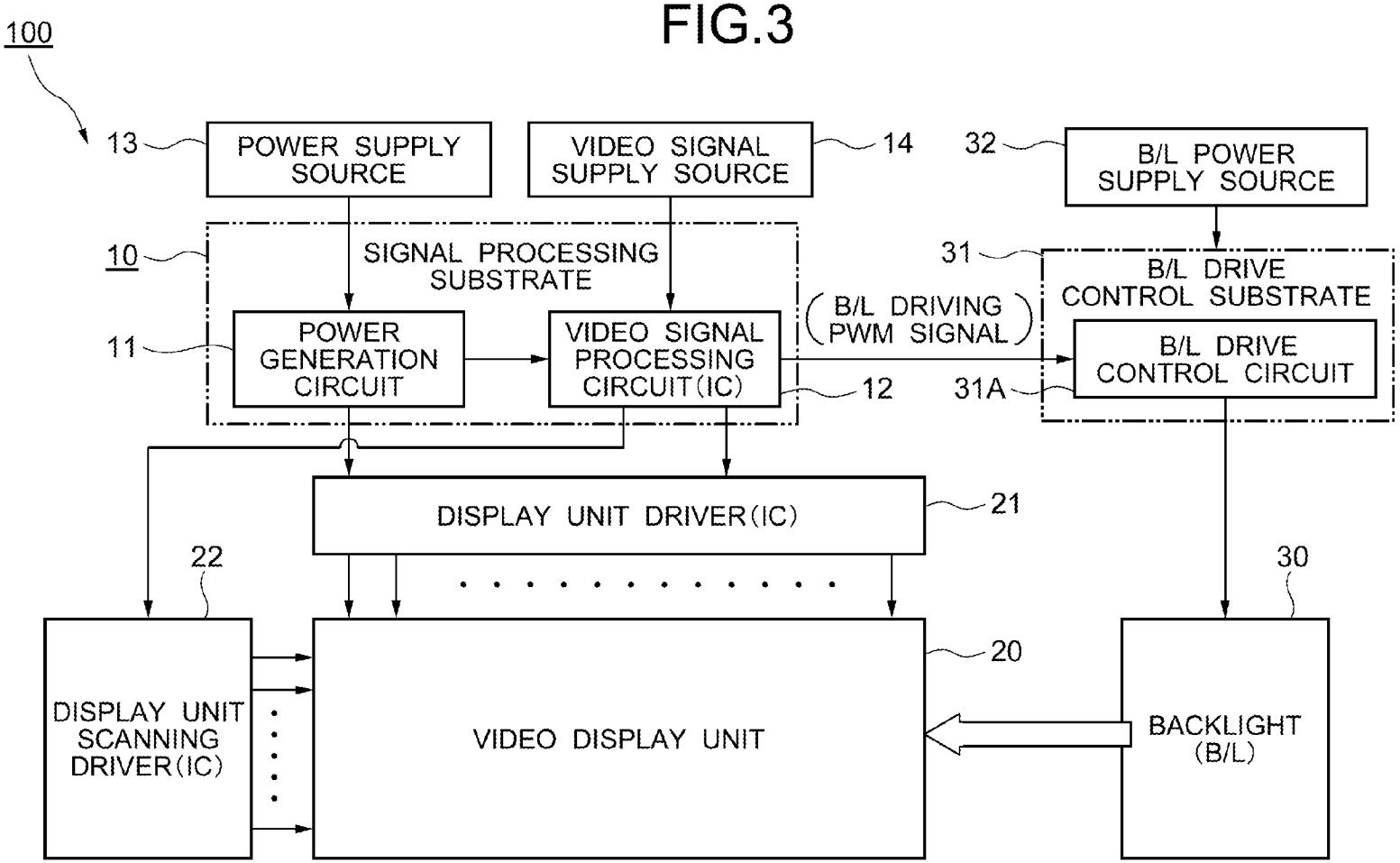
FIG. 3 is a block diagram showing the video display device according to the first exemplary embodiment of the present invention which includes the video signal processing circuit disclosed in FIG. 2.

As shown in FIG. 3, a video display device 100 provided with a video display unit 20 such as a liquid crystal panel includes: a signal processing substrate 10 that is provided with a power source generating circuit 11 such as a DC-DC converter and a video signal processing circuit 12 which performs signal processing regarding video display on the video display unit 20, such as layout conversion of various kinds of signals and the like and generation, transmission, and the like of horizontal/vertical synchronous signals; a power supply source 13 which supplies a power source towards the power source generating circuit 11; a video signal supply source 14 which supplies video signals to the video signal processing circuit 12; a display unit driver 21 which supplies video signals on which each processing is performed and transmitted from the video signal processing circuit 12 to the video display unit 20; and a display unit scanning driver 22 which supplies the horizontal/vertical synchronous signals transmitted from the video signal processing circuit 12 to the video display unit 20.

In addition, the video signal processing circuit 12 transmits the horizontal/vertical synchronous signals also to the display unit driver 21, and the display unit driver 21 supplies those to the video display unit 20 along with the video signals on which each of the processing is performed.

The power source generating circuit 11 employs a structure which generates the power source for driving various kinds of ICs such as the video signal processing circuit 12, the display unit driver 21, the display unit scanning driver 22, and the like.

That is, the video signal processing circuit 12 is structured to perform conversion of data layout for transmitting the video signals inputted from the outside to the display unit driver 21 and generation as well as transmission of the synchronous signals, PWM signals (B/L driving PWM signals), and the like for driving each driver by using the power source supplied from the power source generating circuit 11. Similarly, the display unit driver 21 and the display unit scanning driver 22 are also structured to execute each of processing contents based on the power source supplied from the power source generating circuit 11.

Further, the video display device 100 includes: a backlight (B/L) 30 that is a light source required when showing videos; a B/L drive control substrate 31 provided with a B/L drive control circuit 31A which performs controls regarding driving (light-up and the like) of the backlight 30 based on the drive control signals transmitted from the video signal processing circuit 12; and a B/L power supply source 32 which supplies the power source to the B/L drive control circuit 31A.

That is, the video signal processing circuit 12 generates the PWM signal that is the drive control signal for significantly decreasing the luminance of the backlight 30 and transmits it to the B/L drive control circuit 31A. The B/L drive control circuit 31A driven by the power source supplied from the B/L power supply source 32 lights up the backlight 30 by the luminance amount shown in the PWM signal from the video signal processing circuit 12.

The video display device 100 according to the first exemplary embodiment specifically exhibits a technical feature in the video signal processing circuit 12 which analyzes the video signals inputted from outside, performs conversion processing for adjusting the image quality on the video signals based on the result of the analysis, sends out it to the video display unit 20, and generates and transmits the drive control signals regarding the backlight 30 that lights up the video display unit 20 from the back face. Therefore, specific structural contents regarding the video signal processing circuit 12 will be described next by referring to FIG. 1 and FIG. 2.

Figure 2:
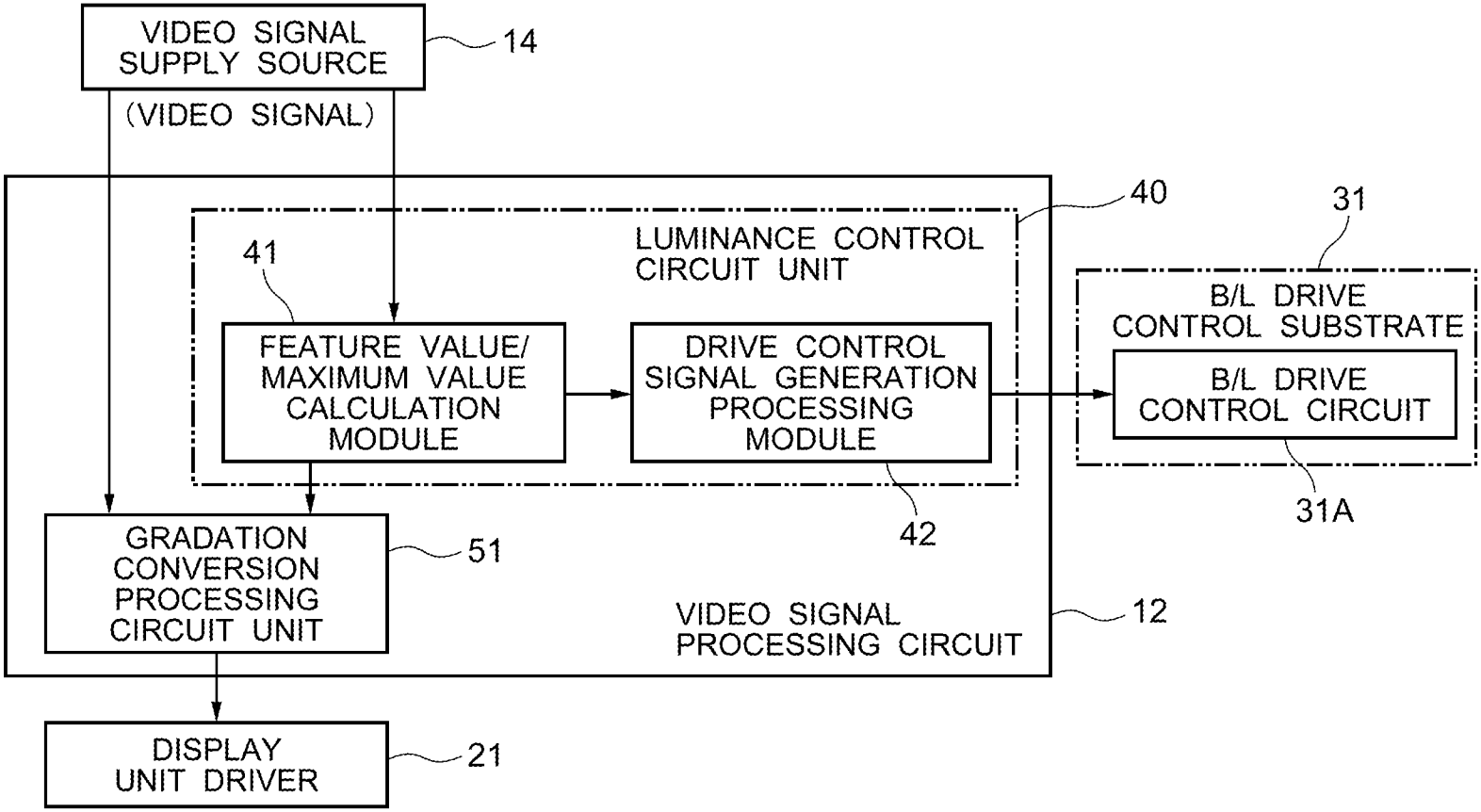
FIG. 2 is a block diagram showing a video signal processing circuit which includes the gradation conversion processing circuit disclosed in FIG. 1.

As shown in FIG. 2, the video signal processing circuit 12 includes: a feature value/maximum value calculation module 41 which calculates the feature value in one frame of the video signal inputted from the video signal supply source 14 and the maximum value of the gradation in one frame; a drive control signal generation processing module 42 which generates and transmits a PWM signal that shows the luminance decrease amount of the backlight 30 by using the feature value calculated by the feature value/maximum value calculation module 41; and a gradation conversion processing circuit unit 51 which executes gamma conversion and the like for complementing the luminance (luminance decrease amount) reduced by the B/L drive control circuit 31A according to the PWM signal received from the drive control signal generation processing module 42.

Further, the structure including the feature value/maximum value calculation module 41 and the drive control signal generation processing module 42 is referred to as a luminance control circuit unit 40. The luminance control circuit unit 40 is structured to execute each processing particularly regarding the luminance control of the backlight 30 based on the video signals inputted from outside.

Note here that the above-described feature value (feature value of the video signal) shows the information that the video signal of one frame inputted from the video signal supply source 14 is "the video signal that is bright as a whole or the video signal that is dark as a whole" with at least one or more numerical values. For example, it is calculated based on a polynomial numerical expression or the like acquired by using the average value and the maximum value of the gradation values of the video signals with the four basic operations of arithmetic.

The feature value/maximum value calculation module 41 according to the first exemplary embodiment is structured to calculate the gradual numerical values showing the degrees of the overall brightness of the inputted video signals of one frame as the feature values. That is, the feature value/maximum value calculation module 41 calculates the feature values that are the degrees of the brightness and darkness of the entire one frame of the inputted video signals put into numerical values.

The extent of the feature values is determined depending on the numerical expressions or the like based on the average value, the maximum value, and the like of the gradations of the video signals. The feature value/maximum value calculation module 41 is structured to calculate the larger numerical value as the inputted video signal is brighter.

Further, it is also possible to employ a structure in which a brightness/darkness judging function (not shown) for judging whether or not the inputted video signals of one frame are the video signals that are bright as a whole is provided to the feature value/maximum value calculation module 41. In that case, the feature value/maximum value calculation module 41 is structured to calculate the relatively large value or small value as the feature value according to each of the judgment results upon judging by the brightness/darkness judging function that the video signals are bright or dark as a whole.

In a case where the feature value calculated as a large value since the video signal are bright as a whole is acquired from the feature value/maximum value calculation module 41, the drive control signal generation processing module 42 performs a control to decrease the luminance decrease amount of the backlight 30 so as not to deteriorate the visibility of the image (image quality). That is, in such case, the drive control signal generation processing module 42 is structured to transmit the PWM signal (drive control signal) to decrease the luminance decrease amount of the backlight 30 to the B/L drive control circuit 31A.

In the meantime, in a case where the feature value calculated as a small value since the video signal are dark as a whole is acquired from the feature value/maximum value calculation module 41, the drive control signal generation processing module 42 performs a control to increase the luminance decrease amount of the backlight 30. That is, in such case, the drive control signal generation processing module 42 is structured to transmit the PWM signal (drive control signal) to increase the luminance decrease amount of the backlight 30 to the B/L drive control circuit 31A so as to suppress the power consumption thereby.

Therefore, when the feature value is calculated by the feature value/maximum value calculation module 41, the drive control signal generation processing module 42 determines the decrease amount of the luminance (luminance decrease amount) of the backlight 30 based on the feature value and transmits the PWM signal showing the luminance amount of the backlight 30 according to the determined amount. Upon receiving it, the B/L drive control circuit 31A performs a control to decrease the luminance of the backlight 30 according to the PWM signal.

However, only with the control for decreasing the luminance of the backlight 30 in this manner, it only darkens the video signals as a whole. This results in deteriorating the visibility of the image.

Thus, the first embodiment employs a structure in which the gradation conversion processing circuit unit 51 increases the gradation of the video signals than the original gradation by corresponding to the luminance decrease amount of the backlight 30 determined by the drive control signal generation processing module 42 so as to increase (adjust) the transmittance of the panel.

Specifically, the feature value calculated by the feature value/maximum value calculation module 41 is used in common by both of the drive control signal generation processing module 42 and the gradation conversion processing unit 51 so as to make correspondence between the luminance decrease amount of the backlight 30 and the gradation conversion processing. Further, the gradation conversion processing unit 51 is structured to change the gamma characteristic regarding the gradation conversion according to the gradation of the video signals inputted from outside.

Here, the specific structural content of the gradation conversion processing circuit unit 51 which complements the decreased luminance of the backlight 30 by the gradation conversion processing of the video signals will be described by referring to FIG. 1.

Figure 1:
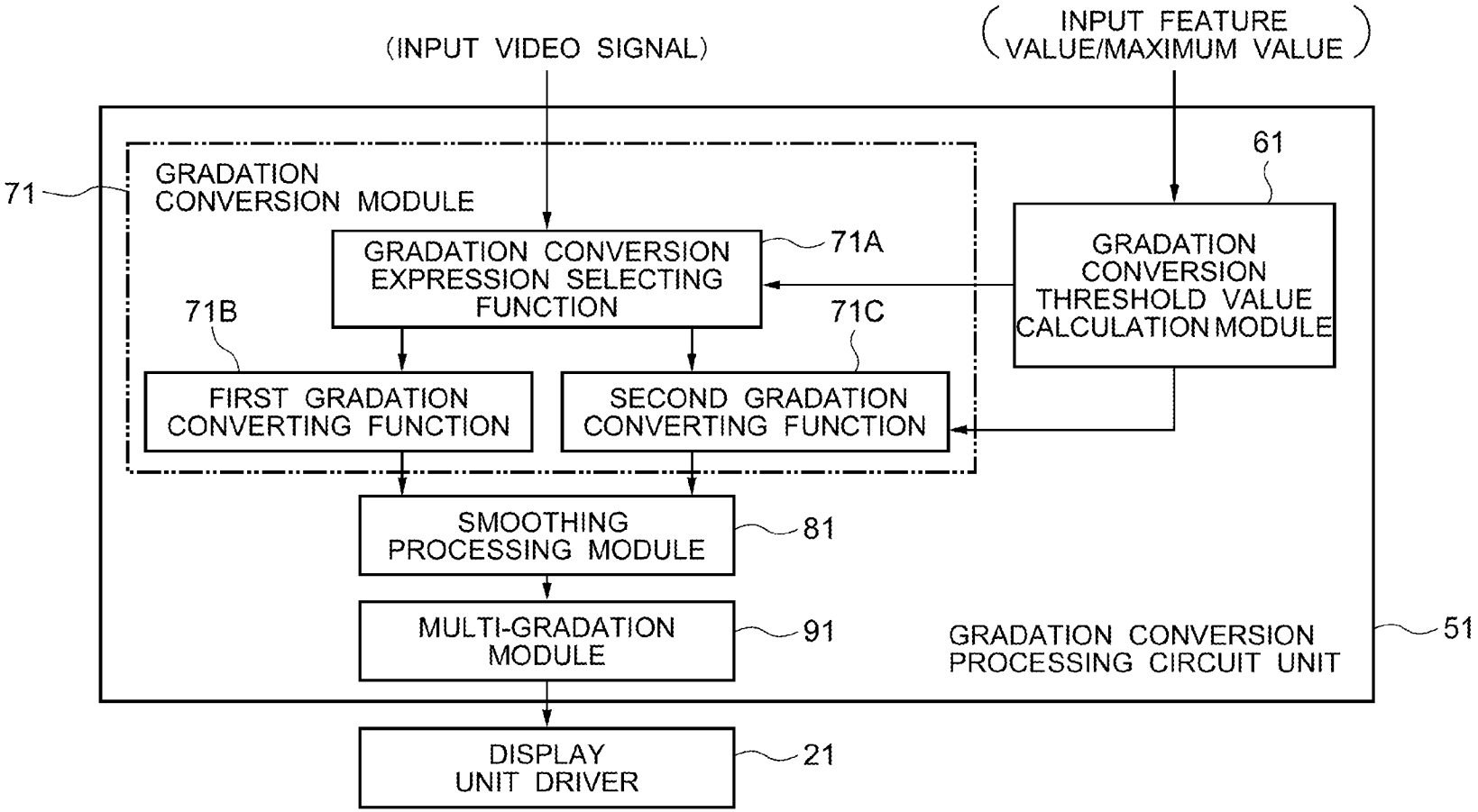
FIG. 1 is a block diagram showing a specific structure of a gradation conversion processing circuit unit which constitutes a video display device according to a first exemplary embodiment of the present invention.

As shown in FIG. 1, the gradation conversion processing circuit unit 51 which executes the gradation conversion processing of the gradation of the video signals based on the feature value calculated by the feature value/maximum value calculation module 41 and the threshold value specified by the feature value includes: a gradation conversion threshold value calculation module 61 which calculates the threshold value regarding conversion of the gradation based on a threshold value calculation expression that is formed based on the feature value and a conversion coefficient set in advance; a gradation conversion module 71 which converts the gradation of the video signals supplied from the video signal supply source 14 based on the threshold value calculated by the gradation conversion threshold value calculation module 61; a smoothing processing module (smoothing processing circuit) 81 which performs significant smoothing processing on the video signals (converted video signals) on which the gradation conversion is done by the gradation conversion module 71; and a multi-gradation processing (multi-gradation circuit) 91 which performs processing for securing the resolution of the gamma-converted gradation as necessary.

The gradation conversion module 71 is structured to perform gradation conversion on the video signals based on a linear function that increases linearly when the gradation of the video signals inputted from the outside is equal to or larger than the threshold value and to perform gradation conversion on the video signals based on a function which is formed based on the feature value or the luminance decrease amount of the backlight 30 and increases in a geometric series manner when the gradation is smaller than the threshold value.

That is, the gradation conversion module 71 performs gradation conversion based on the linear function that increases linearly by taking the region where the gradation thereof is equal to or larger than the threshold value among the video signals inputted from outside as the target and performs gradation conversion based on the function which is formed based on the feature value and increases in a geometric series manner by taking the region where the gradation thereof is smaller than the threshold value among the video signals inputted from the outside.

Further, the function increasing in a geometric series manner and the linear function increasing linearly continue in the border section located at the threshold value.

More specifically, the gradation conversion module 71 includes a gradation conversion expression selecting function 71A which selects one of a plurality of gradation conversion expressions set in advance by comparing the gradations (gradation values) of the inputted video signals and the threshold value calculated by the gradation conversion threshold value calculation module 61 and transmits video signals according to the selection result. In the first exemplary embodiment, a first gradation conversion expression (following Expression 9) and a second gradation conversion expression (following Expression 11) to be described later are employed as the gradation conversion expressions.

Further, the gradation conversion module 71 includes: a first gradation converting function 71B which receives the video signals from the gradation conversion expression selecting function 71A and performs gradation conversion (gradation conversion according to the luminance decrease amount) based on the first gradation conversion expression (gradation conversion expression containing the coefficient for complementing the luminance decrease amount); and a second gradation converting function 71C which performs gradation conversion based on the second gradation conversion expression.

Note here that the gradation conversion threshold value calculation module 61 is structured to give the feature value and the maximum value acquired from the feature value/maximum value calculation module 41 to the gradation conversion expression selecting function 71A of the gradation conversion module 71. The gradation conversion expression selecting function 71A transmits the feature value to the first gradation converting function 71B and the maximum value to the second gradation converting function 71C along with the video signals, respectively.

Further, the gradation conversion threshold value calculation module 61 is structured to transmit the threshold value calculated in the manner described above to the second gradation converting function 71C.

That is, the gradation conversion module 71 is structured to select the gradation conversion expression used for gradation conversion by the gradation conversion expression selecting function 71A and to convert the gradations of the actually inputted video signals by the first gradation converting function 71B or the second gradation converting function 71C.

In a case where the decreased luminance of the backlight 30 is complemented by gradation conversion, it is originally desirable to perform uniform gradation conversion based on a single gradation conversion expression or the like on the gradations of all the inputted video signals (referred to as input gradations hereinafter) as complementation corresponding to the luminance decrease amount (e.g., 25%) of the backlight 30.

However, when such uniform gradation conversion is performed in a case where 254 gradations or 255 gradations as a high gradation region are inputted in a part of a screen, for example, there is a possibility that 254 gradations can be converted to 255 gradations. However, 255 gradations are remained as 255 gradations since there are no greater gradation values so that gradation conversion thereof is impossible.

That is, with the uniform gradation conversion executed without considering such high gradation region, the so-called gradation collapse is generated in which the inputted gradations of higher than a specific gradation value all become same gradations. This causes tremendous deterioration in the image quality.

Therefore, as described above, the first exemplary embodiment employs a structure with which the luminance decrease amount of the backlight 30 is complemented by the gradation conversion module 71 by performing the gradation conversion based on the two gradation conversion expressions. That is, employed is the structure with which: a given threshold value is provided for gradation conversion performed by the gradation conversion module 71; complementation is performed by the gradation conversion according to the luminance decrease amount when the inputted gradation is smaller than the threshold value; and the gradation conversion using another gradation conversion method that is different from the above-described complementation is performed in order to avoid the gradation collapse and the like when the input gradation exceeds the threshold value.

As the gradation conversion method for avoiding the gradation destruction and the like, the first exemplary embodiment employs a method which performs gradation conversion based on a straight line or a curve connected between the maximum expression gradations (e.g., 255 in a case of 8-bit input, for example) and the threshold value calculated by the gradation conversion threshold value calculation module 61. This makes it possible to perform gradation conversion processing with which the gradations within a range between the threshold value and the maximum gradation do not become the same gradations (except for a case where original inputted gradations are same gradations).

The smoothing processing module 81 is structured to: judge whether the gradation of the video signals inputted from the outside to the smoothing region set in advance belongs to the region near the threshold value calculated by the gradation conversion threshold value calculation module 61; calculate a smoothing coefficient based on a difference between the threshold value and the inputted gradation; subtract it from the gradation of the video signals when judged as belonging to the smoothing region; and output the video signals in the original state when judged as not belonging to the smoothing region.

(Specific Structures)

As described above, in the first exemplary embodiment, particularly the gradation conversion processing circuit unit 51 which performs complementation of the luminance decrease amount of the backlight 30 determined based on the feature value of the video signals by the gradation conversion or the like functions effectively. Therefore, it is possible to achieve low power consumption and to suppress deterioration in the image quality and the like.

Thus, in the followings, more detailed structural contents of the gradation conversion processing circuit unit 51 regarding the above-described gradation conversion and the like will be described by exemplifying specific numerical values and the like. Here, assumed is a case where the gradation expression number (gradation number) of the inputted video signals is 8 bits (the gradation values are values of 0 to 255).

It is so structured that the luminance decrease amount of the backlight 30 is determined by the drive control signal generation processing module 42 based on the feature value (also referred to as Rank hereinafter) within a given frame and the maximum gradation value (also referred to as f(n) hereinafter) that can be displayed within a given frame of the inputted video signals.

In the first exemplary embodiment, PWM (PWM value) which shows the luminance amount after being decreased is generated by the drive control signal generation processing module 42 based on following Expression 1.

(Expression 1)

$$PWM=(\mathrm{Rank}/f(n))\hat{}2.2 \quad (1)$$

As described above, "Rank" is the feature value (values from 0 to 255 in a case of 8 bits) in one frame of the video signals, and "f(n)" shows the maximum gradation value number (2^n−1: n is the gradation expression number) which can be displayed within one frame (f(n)=2^n−1). This also applies in the followings.

As in the first exemplary embodiment, the maximum gradation number can be expressed as f(8)=255 in a case where the gradation expression number set in advance is 8 bits (n=8).

Note here that PWM (PWM value) directly calculated according to Expression 1 described above is a value (%) that shows the proportion of the luminance amount of the backlight 30. For example, when Rank=224, PWM is determined as 75%. Thus, the luminance decrease amount of the backlight 30 in that case is 25%.

That is, there is a relation of "luminance decrease amount (%)=100−PWM" established between PWM that shows the luminance amount and the luminance decrease amount. Therefore, the PWM signal can be considered also as a drive control signal showing the luminance decrease amount.

Next, specific structural contents regarding calculation of the threshold value done by the gradation conversion threshold value calculation module 61 will be described.

First, in a case where it is assumed that the threshold value regarding the conversion of the gradation described above is Xa and the relative luminance value in the gradation of the threshold value (Xa) is α, the coefficient α can be expressed with following Expression 2 and it can be expressed with following Expression 3 when Expression 1 described above is substituted to Expression 2. Further, through solving Expression 3, following Expression 4 (threshold value calculation expression) for calculating the threshold value (Xa) can be acquired.

(Expression 2)

$$\alpha=\{(Xa/f(n))\hat{}2.2\}\times(1/PWM) \quad (2)$$

(Expression 3)

$$\alpha=\{(Xa/f(n))\hat{}2.2\}\times(f(n)/\mathrm{Rank})\hat{}2.2\} \quad (3)$$

(Expression 4)

$$Xa=\alpha\hat{}(1/2.2)\times\mathrm{Rank} \quad (4)$$

The first exemplary embodiment is so structured that the coefficient α shown in Expression 4 is set in advance as the conversion coefficient described above. That is, the gradation conversion threshold value calculation module 61 is structured to calculate the threshold value (Xa) regarding conversion of the gradation according to Expression 4 described above based on the conversion coefficient (α) set in advance and the feature value (Rank) acquired from the feature value/maximum value calculation module 41.

Subsequently, the structure regarding the gradation conversion processing executed by the gradation conversion module 71 will be described in a specific manner by referring to FIG. 4 which exemplifies graphs regarding the gradation conversion method of the first exemplary embodiment.

Each of the graphs plotted therein shows the relation between the input gradations on the lateral axis and the relative luminance degree (relative luminance when the maximum luminance is defined as 1) of the video display unit 20 on the longitudinal axis, and a curve shown with broken line is a gamma curve showing the gradation characteristic when γ=2.2. In the meantime, the relation between the input gradations and the relative luminance regarding the gradation conversion method of the first exemplary embodiment can be shown with a curve shown in the region (the first gradation region) from the origin O to the threshold value (Xa) and a straight line shown in the region (the second gradation region) from the threshold value (Xa) to the maximum gradation number. FIG. 4 exemplifies the gradation conversion method when PWM=75%.

Further, the first conversion expression used by the gradation conversion module 71 when the input gradation is smaller than the threshold value (Xa) (Xa>input gradation) and the second gradation conversion expression used by the gradation conversion module 71 when the input gradation is equal to or larger than the threshold value (Xa) (Xa≤input gradation) can be expressed with following Expression 5 and Expression 6, respectively. "MAX" in Expression 6 is the maximum value of the gradation in a given frame of the video signals.

(Expression 5)

$$\text{Relative luminance}=(1/PWM)\times(\text{Input gradation}/f(n))\hat{}2.2 \quad (5)$$

(Expression 6)

$$\text{Relative luminance}=\{(1-\alpha)/(\text{MAX}-Xa)\}\times(\text{Input gradation}-\text{MAX})+1 \quad (6)$$

Expression 5 (the first gradation conversion expression) described above is a function increasing in a geometric series manner which employs a structure in which a reciprocal of PWM (a coefficient for complementing the luminance decrease amount) is integrated to the value that depends on the input gradation and the gradation expression number (n). That is, it means to achieve complementation of the amount corresponding to the luminance decrease amount by the gradation conversion executed by the first gradation converting function 71B based on the first gradation conversion expression.

Further, Expression 6 (the second gradation conversion expression) employs a structure which linearly connects between the maximum gradation (the maximum gradation number: 255 in this case) in one frame of the video signals and the threshold value (Xa) in order not to destruct the input gradation on the high gradation side (for not causing the gradation collapse on the high gradation side).

That is, the second gradation conversion expression (the gradation conversion expression structured based on the threshold value and the maximum value) showing a linear function which increases linearly is structured to show a straight line connected between the gradation of the threshold value (Xa) and the maximum gradation defined by the gradation expression number set in advance in a straight manner.

Further, each of the gradation conversion expressions employs the structure which continues in the end parts (border sections) located at each of the borders. That is, the graph showing those is continuously connected so that there is no missing of the gradations as shown in FIG. 4. The entire connected graph is referred to as a gradation conversion curve for convenience.

As described, the structure with which the two gradation conversion expressions are selectively used according to the gradation in one frame of the video signals is employed, so that it is possible to suppress deterioration in the image quality to minimum and to decrease the luminance of the backlight 30 significantly.

The principle (principle of the luminance control) of the processing for decreasing luminance of the backlight 30 and the gradation conversion executed by corresponding thereto is as described above. However, when the circuit is structured based on Expressions 5 and 6 described above for executing calculation via the relative luminance, the circuit scale becomes increased.

Thus, a gradation conversion expression for directly acquiring the output gradation (gradation of the video signals to be outputted) for the input gradation will be derived based on the above-described principle.

The relative luminance (relative luminance value) can be expressed as in following Expression 7 by using the output gradation and f(n) mentioned above. By applying it, Expression 5 described above can be expressed as in following Expression 8.

(Expression 7)

$$\text{Relative luminance}=(\text{Output gradation}/f(n))\hat{}2.2 \quad (7)$$

(Expression 8)

$$(\text{Output gradation}/f(n))\hat{}2.2=(1/PWM)\times(\text{Input gradation}/f(n))\hat{}2.2 \quad (8)$$

Further, through arranging Expression 8 by using Expression 1 described above, the first gradation conversion expression (Xa>input gradation) can be expressed as in following Expression 9 instead of Expression 5 described above.

(Expression 9)

$$\text{Output gradation}=(f(n)/\text{Rank})\times\text{Input gradation} \quad (9)$$

The relative luminance regarding the second gradation conversion expression can also be expressed with an expression of "Relative Luminance=(Output gradation/MAX)^2.2" as in the above. However, when it is combined with Expression 6 described above, only "Output gradation/MAX)^2.2" which corresponds to the left side becomes an exponential function. Thus, calculations thereof become complicated.

Therefore, in the first exemplary embodiment, the relative luminance is expressed not with "Output gradation/MAX)^2.2" but with following Expression 10 using a linear approximation expression.

Note here that X2.2 is the gradation value when the relative luminance is a on the gamma curve of $\gamma=2.2$ (gradation value corresponding to the relative luminance a).

(Expression 10)

$$\text{Relative Luminance}=\{(1-\alpha)/f(n)-X2.2\}\times(\text{Output gradation}-f(n))+1 \quad (10)$$

Further, through arranging it by using Expression 6 and Expression 10 described above, the second gradation conversion expression (Xa≤input gradation) can be expressed as in following Expression 11 instead of Expression 6.

(Expression 11)

$$\text{Output gradation}=f(n)+(f(n)-X2.2)/(\text{MAX}-Xa)\}\times(\text{Input gradation}-\text{MAX}) \quad (11)$$

The above-described contents can be summarized as follows. The gradation conversion threshold value calculation module 61 is structured to execute the calculation processing of the threshold value regarding the gradation conversion based on Expression 4 described above, and the gradation conversion module 71 is structured to execute the gradation conversion based on Expression 9 described above under the condition of "Xa>input gradation" and to execute the gradation conversion based on Expression 11 described above (the gradation conversion expression formed based on the threshold value and the maximum value) under the condition of "Xa≤input gradation".

Both of Expressions 9 and 11 are structured with simple numerical expressions using no exponential functions. Thus, with the first exemplary embodiment in which the circuit regarding the gradation conversion module 71 based on those numerical expressions, significant gradation conversion processing can be achieved with an extremely small circuit structure.

Further, regarding the value of α, it is found as a result of the image quality check to be described later that α=0.6 is the optimum value.

Note here that when α=0.6 is determined and set as a fixed value, Expression 4 described above can be approximately expressed as in following Expression 12 which can also be rewritten to following Expression 13.

(Expression 12)

$$Xa=(203/256)\times\text{Rank} \quad (12)$$

(Expression 13)

$$Xa=(203\times\text{Rank})/256 \quad (13)$$

According to Expression 13 (the threshold value calculation expression), the value of the threshold value (Xa) can be generated by performing multiplication of Rank and 203 once and by performing division by n-th power of 2 (256=2^8) once. Further, when the circuit is actually created based on Expression 13 described above, a single multiplier is sufficient and bit shift can be applied for the division by the n-th power of 2 so that a substantial divider is not necessary.

Therefore, with the first exemplary embodiment, it is possible to structure the gradation conversion threshold value calculation module 61 with a single multiplier and a single register (shift register). That is, a significant threshold value (Xa) can be calculated with an extremely small scaled circuit structure.

Now, Expressions 1 to 13 described above and the processes and the like by which each of those expression is derived will be described in details.

First, Expression 1 that is the expression for acquiring the PWM value is structured to calculate the PWM value through calculating the power of 2.2 to the value acquired by dividing the feature value (the image feature value: Rank) with the maximum gradation value (f(n)) based on the luminance information.

Next, Expression 4 mentioned above will be described.

In a case where luminance is increased by performing gradation conversion, gradation collapse occurs in the region where the gradation is equal to or larger than a specific gradation when the luminance magnification (conversion magnification) of the entire gradations is set uniform (e.g., when a luminance magnification larger than 1 is multiplied to 255 gradations, the value acquired thereby becomes a numerical value larger than 255 and exceeds the maximum gradation number, so that gradation expression cannot be done).

That is, there is no problem even when gradation conversion is performed with a uniform luminance magnification up to a specific point. However, after that point, it is necessary to lead the luminance magnification to a decreasing direction in order to avoid the gradation collapse effectively.

Therefore, the first exemplary embodiment employs the structure with which the border point as the basis for decreasing the luminance magnification is determined, gradation conversion (gradation conversion according to the luminance decrease amount) is performed by a uniform luminance magnification up to the border point, and gradation conversion is performed thereafter based on the function that decreases the luminance magnification than the gradation conversion according to the luminance decrease amount.

The border point (a specific point) to be the basis is the threshold value (Xa) calculated by the gradation conversion threshold value calculation module 61 based on Expression 4 described above. The threshold value (Xa) is derived based on the feature value (Rank) and the coefficient α (the relative luminance corresponding to the point of the threshold value).

Subsequently, Expression 5 described above is so structured that the luminance magnification becomes uniform when the gradations of the video signals inputted from outside are smaller than the threshold value (Xa).

The value of "1/PWM" in Expression 5 is the uniform luminance magnification. The luminance of the backlight 30 is decreased based on the PWM value, so that a reciprocal of the PWM value is defined as the luminance magnification. For example, when PWM=0.75, the luminance of the backlight 30 is the value of 75% with respect to 100% (the luminance decrease amount in this case is 25%). That is, 1.33 which is the reciprocal of the PWM value is the luminance magnification.

In the meantime, in a case of exceeding the threshold value (Xa), employed is Expression 6 that is based on the structure in which the threshold value (Xa) and the maximum gradation number (255 in this case) are connected linearly. Expression 6 shows a linear function that goes through the point (MAX, 1) and has a slope of "(1−α)/(MAX−Xa)" as shown in FIG. 4.

As described above, there are two points as the reasons for forming Expression 6 to be a linear function (linear form).

One is to achieve the object of reducing the circuit scale further through simplifying the calculations that constitute the expression as much as possible. The other one is for not causing a sense of uncomfortableness in the image quality through suppressing gradation collapse as much as possible regarding the pixels on the higher gradation side than the gradation of the threshold value (Xa).

Now, the latter reason will be described in more details.

In an image that is dark as a whole, for example, the feature value of the video signals becomes small as described above so that the threshold value (Xa) also becomes a small value (see Expression 4). However, there is a possibility that a high gradation region may exist partially. The first exemplary embodiment employs Expression 6 described above to be a linear function to accurately perform gradation expression and avoid gradation collapse even in a case where the high gradation region is not of the same gradation but has a slight gradation difference.

Supposing that the gradation difference in the high gradation region is very small, there is no significant issue even when gradation conversion is performed by employing a curve or the like with a large curvature. However, the actual video signals are of variety of types so that the differences in the gradation values are of great variations. Thus, when gradation conversion based on the curve or the like with a large curvature is executed without considering such circumstances, there is necessarily generated a part where the slope becomes gradual and gradation collapse tends to occur in that part.

That is, the video display device 100 according to the first exemplary embodiment employs the linear function to the second gradation conversion expression used by the gradation conversion module 71. Therefore, even when there is a high gradation region having a slight gradation difference within an image that is dark as a whole, it is possible to perform gradation conversion thereof more accurately.

Note here that the extent of the threshold value (Xa) used by the gradation conversion expression selecting function 71A when selecting the first gradation conversion expression or the second gradation conversion expression is an extremely important factor for performing significant gradation conversion. That is, it is possible to cause such inconveniences that the gradation collapse after gradation conversion becomes conspicuous when the threshold value (Xa) is set on the high gradation side excessively and the reduction effect of the power consumption becomes small when the threshold value (Xa) is set on the low gradation side excessively.

Considering that the threshold value (Xa) can be acquired by determining the coefficient α (see Expression 4), it is necessary to set in advance the optimum value for the coefficient α considering the balance between suppression of the deterioration in the image quality and the reduction effect of the power consumption.

Therefore, in order to select the optimum value for the coefficient α, a bright part (high gradation part) in the image is focused. Through comparing the bright part before gradation conversion is performed and the bright part after the gradation conversion is performed, a point where a sense of uncomfortableness in the image quality (gradation collapse) is as small as possible is searched, and the optimum value acquired thereby is employed as the value of the coefficient α in the first exemplary embodiment. As described above, the optimum value for the coefficient α is 0.6 (α=0.6) as described above.

As described above, Expressions 7 to 11 are acquired by putting the relative luminance value of Expressions 5 and 6 into the gradation value to form numerical expressions.

Expressions 12 and 13 described above are derived based on the fact that Expression 4 becomes "Xa=0.6^(1/2.2)×Rank", i.e., "Xa=0.796×Rank", when α=0.6.

For deriving Expression 13, 0.6 that is the optimum value for the coefficient α is employed based on the result of image quality check. However, even in a case where the value of a is determined arbitrarily, the numerical expression for calculating the threshold value (Xa) can be revised to a same form as that of Expression 13 described above.

That is, it can be expressed as in following Expression 15 by using β defined in following Expression 14. It is to be noted that a decimal part generated when calculating β by using Expression 14 is disregarded.

(Expression 14)

$$\beta=256\times\alpha\hat{}(1/2.2) \tag{14}$$

(Expression 15)

$$Xa=(\beta\times\mathrm{Rank})/256 \tag{15}$$

Therefore, in a case where the first exemplary embodiment employs the structure where the value of the coefficient α is determined arbitrarily, the gradation conversion threshold value calculation module 61 is structured to calculate β as an integer by using Expression 14 described above and to calculate the threshold value (Xa) by applying it to Expression 15 described above.

By the use of Expressions 14 and 15, whatever value might be set as the coefficient α, the value of the threshold value (Xa) can be generated by performing multiplication of the feature value (Rank) and the integer (β) once and by performing division by n-th power of 2 (256=2^8) once. Therefore, practically, the value of the threshold value (Xa) can be calculated significantly by a circuit of a simple structure which includes a single multiplier and a single register.

The contents described above are the processes and the like by which Expressions 1 to 13 and Expressions 14 and 15 are derived.

In the first exemplary embodiment, Expressions 13, 9, and 11 regarding the circuit structure of the gradation conversion processing circuit unit 51 are all constituted only with the four basic operations of arithmetic such as addition, subtraction, multiplication, and division without including an exponential function with which calculations become complicated and the circuit scale becomes large.

Further, each parameter in the numerical expressions is a fixed value set in advance or a numerical value generated only from the information regarding the video signals to be inputted.

Therefore, it is possible to achieve gradation conversion with which deterioration in the image quality is suppressed as much as possible with an extremely small circuit structure by the use of the gradation conversion processing circuit unit 51 which includes the gradation conversion threshold value calculation module 61 that employs a simple circuit structure based on Expression 13 and the gradation conversion module 71 that employs the gradation conversion expressions (Expressions 9 and 11) which can be constituted with two simple circuits.

Next, the principle and necessity of smoothing processing executed by the smoothing processing module 81 will be described.

The part at which the first gradation conversion expression (Expression 9) and the second gradation conversion expression (Expression 11) are connected becomes an inflection point generated due to a difference in the characteristics of each of those expressions.

The inflection point herein is the point at which the characteristic of the graph changes before and after thereof when the entire graph in a line is focused.

Figure 4:
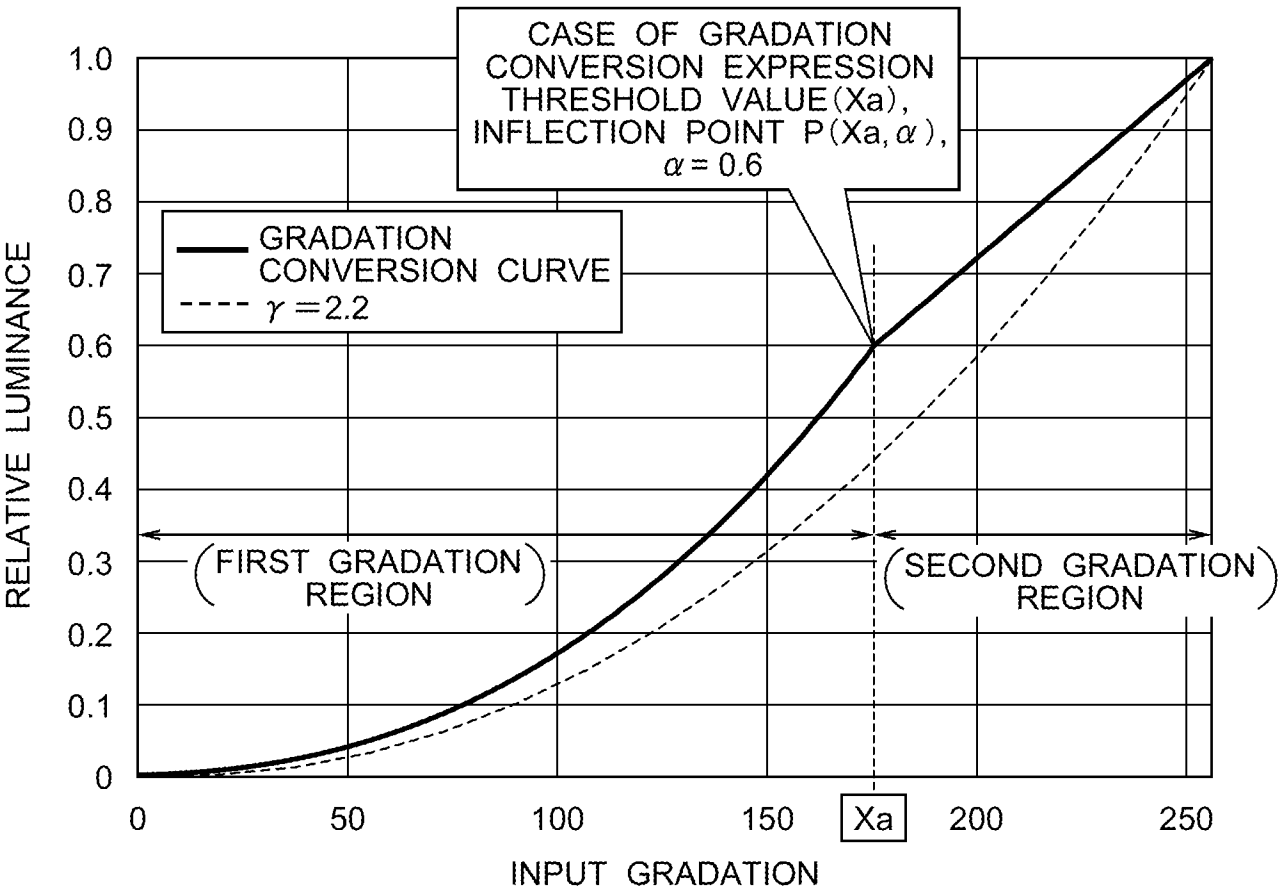
FIG. 4 is a graph which shows a gradation conversion method employed by the video display device disclosed in FIG. 3.

In the first exemplary embodiment, as shown in the graph of FIG. 4, the slope of the tangent of the curve regarding the first gradation conversion expression and the slope of the straight line regarding the second gradation conversion expression are different at the inflection point P (Xa, α) located at the threshold value (Xa), so that the peripheral part of the inflection point P is swollen upwards even though it is a very small amount. That is, in the peripheral part of the inflection point P, the smoothness is lost in proportional to the rough shapes of the curve of the first gradation region and the straight line of the second gradation region.

When there is such inflection point, the gradation difference in the vicinity of the gradation at the inflection point is viewed conspicuously (e.g., viewed as a border line) in a case of a gray scale display (a screen display with which display is started from 0 gradation in the vertical direction or the lateral direction and continues to the maximum gradations through incrementing the gradation by 1), for example. In other words, that may cause deterioration in the image quality.

In order to prevent such deterioration in the image quality in advance, in the first exemplary embodiment, the smoothing processing module 81 is provided within the gradation conversion processing unit 51 as shown in FIG. 1 as the structure for connecting the first gradation conversion expression and the second gradation conversion expression more smoothly so as to smoothen the peripheral part of the flection point further.

The smoothing processing herein is the processing for suppressing deterioration in the image quality that may be caused in the manner described above where the input gradations are in the vicinity of the threshold value (Xa).

Here, explanations will be provided by defining the range within ±A gradations from the threshold value (Xa) (A is an arbitrary coefficient: a coefficient corresponding to the intensity of subtraction and the subtraction range) as the vicinity (smoothing region) of Xa.

That is, in a case where the input gradation correspond to the smoothing region of "Xa−A≤input gradation≤Xa+A", the smoothing processing module 81 is structured to perform smoothing processing for smoothing the vicinity of the inflection point. The smoothing processing is executed based on a calculation method with which a coefficient (referred to as a smoothing coefficient hereinafter) including both "a coefficient having a square of the input gradation" and "a coefficient of a difference between MAX and Rank" is subtracted from the input gradation.

The smoothing coefficient can be calculated based on following Expression 16. Therefore, specific numerical expression regarding the smoothing processing executed in a case where the input gradation of the video signals belongs to the smoothing region of "Xa−A≤input gradation≤Xa+A" or correspond to a condition of "input gradation<Xa−A or Xa+A<input gradation" can be expressed as following Expression 17 or Expression 18, respectively.

(Expression 16)

$$\text{Smoothing coefficient}=\{(A-|Xa-\text{Input gradation}|)\hat{}2\}\times\{(\text{MAX}-\text{Rank})/(2\hat{}n)\} \quad (16)$$

As described above, Xa is the threshold value regarding gradation conversion, MAX is the maximum value of the gradation in one frame of the video signals, Rank is the feature value in one frame of the video signals, A is an arbitrary coefficient (coefficient corresponding to the intensity of subtraction and the subtraction region), and n is an arbitrary coefficient (recommended value of a case of 8 bits is 8).

(Expression 17)

$$\text{Output gradation}=\text{Input gradation}-\text{Smoothing coefficient} \quad (17)$$

(Expression 18)

$$\text{Output gradation}=\text{Input gradation} \quad (18)$$

For example, in a case where the input gradation is Xa±b (b is a positive number satisfying "b≤A"), "(A−|Xa−Input gradations|)^2" which is the coefficient of Expression 16 described above becomes "(A−b)^2". Therefore, "(A−b)^2" becomes smaller as the value of b becomes larger while "(A−b)^2" becomes larger as the value of b becomes smaller.

That is, through including "(A−|Xa−input gradation|)^2" which is the "coefficient including a square of the input gradation" herein in the structure of the smoothing coefficient, it is possible to perform processing for reducing the subtraction amount in the vicinity of the gradation of Xa−A or Xa+A and to increase the subtraction amount as going closer to Xa. Thereby, the vicinity of the inflection point can be smoothened.

Further, through including "MAX−Rank" which is the difference between the maximum value (MAX) and the feature value (Rank) in the coefficient, it is possible to achieve the processing for reducing the subtraction amount when the difference is small and for increasing the subtraction amount when the difference is large.

As such circumstances where the difference between the maximum value (MAX) and the feature value (Rank) is small, assumed may be a case where most of the pixels in one frame are of the same gradations, for example, i.e., a case of display of a solid screen (raster screen). In such circumstances, it is unnecessary to perform smoothing processing since there is no existence of inflection point of a gamma curve (γ curve) in the first place. Thus, there is no issue of deterioration in the image quality even when the subtraction amount is reduced as described above.

The smoothing processing can be mounted as the processing to be executed after the gradation conversion. As shown in FIG. 1, the first exemplary embodiment is structured to perform the processing by the smoothing processing module 81 on the gradation-converted video signals acquired from the gradation conversion module 71.

Now, the processes and the like by which Expressions 16 to 18 described above are derived will be described in details.

As described above, the smoothing processing is designed to smoothen the vicinity of the flection point at the threshold value (Xa). In order to achieve such object, it is necessary to perform the processing with which the subtraction value is increased at the position close to the threshold value (Xa) for the input gradations and the subtraction value is decreased gradually as leaving away from the threshold value (Xa).

The processing which increases the subtraction value as the distance from the threshold value (Xa) is closer and decreases the subtraction value as the distance from the threshold value (Xa) is farther can be achieved by using an arithmetic expression with which the distance from the threshold value (Xa) is calculated and the value acquired by subtracting the calculated distance from a specific value is squared.

Therefore, in the first exemplary embodiment, when the input gradation belongs to the smoothing region expressed by a conditional expression "Xa−A≤input gradation≤Xa+A" that uses the arbitrary coefficient A as the specific value, the structure with which |Xa−input gradation| that is the difference between the threshold value (Xa) and the input gradation is calculated and the value "A−|Xa−input gradation|" acquired by subtracting it from the coefficient A as the specific value is squared is employed into Expression 16 described above.

Further, when the feature value (Rank) is close to the maximum value (MAX), the luminance magnification is low so that the inflection point is not an issue. Thus, there is no inconvenience even if the subtraction value itself is decreased. Therefore, Expression 16 described above is structured to multiply the value calculated by "(A−|Xa−input gradation|)^2" described above and the value of "(MAX−Rank)".

As described above, the subtraction value of Expression 17 described above is the smoothing coefficient determined by Expression 16 described above. That is, Expression 17 is an arithmetic expression showing the processing which actually subtracts the smoothing coefficient from the input gradation. By using it, it is possible to smoothen the vicinity of the inflection point when the distance between the input gradation and the threshold value (Xa) is close.

In the meantime, there is no influence in the vicinity of the flection point when the distance between the input gradation and the threshold value (Xa) is far, so that it is unnecessary to perform the subtraction processing. Thus, Expression 18 described above which shows the smoothing processing of a case satisfying the conditional expression "input gradation<Xa−A or Xa+A<input gradation" constitutes the processing with which the smoothing processing module 81 outputs the video signals acquired from the gradation conversion module 71 in the original state.

The above is the process by which Expressions 16 to 18 described above are derived. Each of those expressions is structured to be used by the smoothing processing module 81 for judging whether or not the conditional expression "Xa−A≤input gradation≤Xa+A" is satisfied and when executing the subtraction processing regarding the smoothing processing.

That is, the smoothing processing module 81 is structured to include a threshold value vicinity judging function (not shown) which judges whether or not the gradation of the gradation-converted video signals (converted gradation) received from either the first gradation converting function 71B or the second gradation converting function 71C belongs to the smoothing region set in advance and to execute the smoothing processing of the video signals based on Expression 16 and Expression 17 when judged by the threshold value vicinity judging function to belong to the smoothing region.

In Expression 16 described above, "n" is a fixed value and the square can be replaced with the multiplication. Thus, it can be said that Expressions 16 to 18 described above are constituted only with the four basic operations of arithmetic. Further, each parameter in Expression 16 is a fixed value set in advance or generated based only on the information of the video signals to be inputted. That is, the smoothing processing module 81 structured based on each of those expressions employs an extremely simple circuit structure.

Through including the smoothing processing module 81 in the structure of the gradation conversion processing circuit unit 51, it becomes possible to prevent generation of the inflection point in the part where the two gradation conversion expressions of different gradations from each other are connected. This makes it possible to improve the image quality further.

The input gradation in Expressions 16 to 18 is the input gradation regarding the video signals inputted to the smoothing processing module 81, i.e., the input gradation regarding the video signals on which the gradation conversion is performed by the gradation conversion module 71 (the converted input gradation).

Considering the actual gradation conversion, a multi-gradation technique using FRC (Frame rate control) or the like may become necessary for securing the resolution of the gradation after executing gamma conversion. FRC is a technique which increases the number of developed colors in a pseudo manner by utilizing the afterimage effect of human eyes through switching the frame rate of the liquid crystal display or the like at a high speed.

In view of such circumstances, the first exemplary embodiment employs a multi-gradation module (multi-gradation circuit) 91 for performing multi-gradation processing regarding the FRC in the structure of the gradation conversion processing circuit unit 51.

For example, it is necessary to have the resolution of acquired by multiplying "2^m" to the output gradation when performing FRC of m bits (m is an arbitrary natural number). This can be achieved by employing in advance a coefficient that is set according to the required resolution into the numerical expression regarding the gradation conversion.

Considering a case of using 2-bit FRC, for example, it is possible to secure the resolution by multiplying a coefficient 4 to the right sides of Expression 9 and Expression 11 described above. Even with such structure, the principle itself of each of the above-described numerical expressions does not change. Therefore, there is no influence imposed upon the precision of the gradation conversion processing.

(Explanations of Actions)

Actions of the video signal processing circuit 12 and the video display device 100 disclosed in FIGS. 1 to 3 will be described by referring to flowcharts shown in FIG. 5 and FIG. 6.

Here, actions regarding each of the circuit blocks which function for controlling the luminance of the backlight 30 according to the video signals inputted from outside will be described by referring to FIG. 5.

Figure 5:
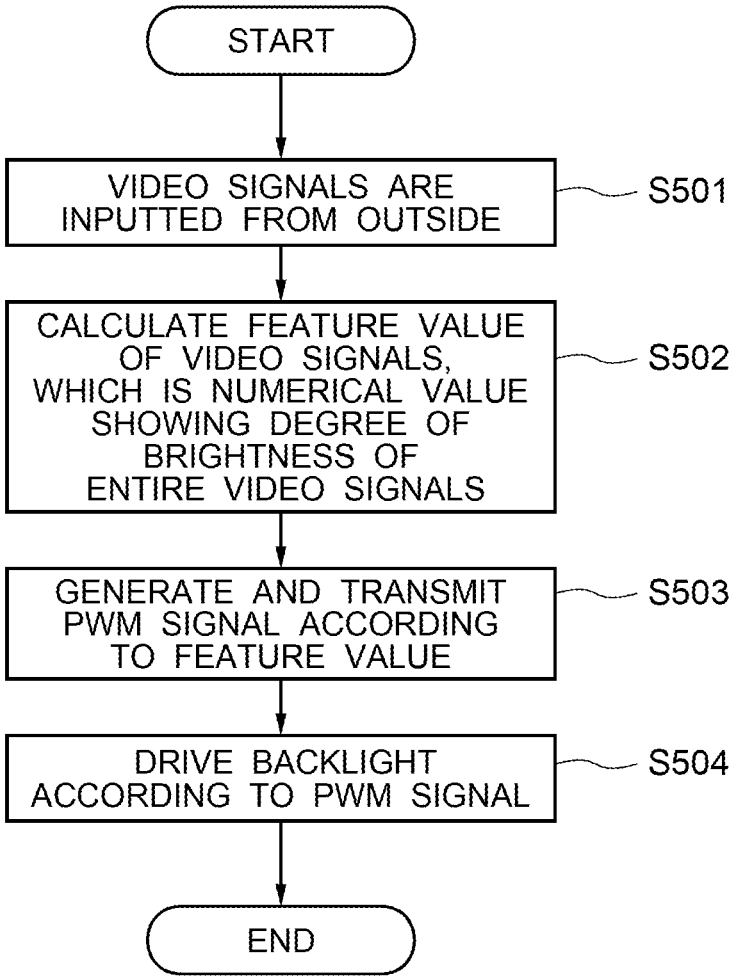
FIG. 5 is a flowchart showing actions regarding control of the luminance of a backlight done by the video signal processing circuit disclosed in FIG. 2.

When video signals for providing display on the video display unit 20 are inputted from the video signal supply source 14 (FIG. 5: S501), the feature value/maximum value calculation module 41 upon acquiring the video signals calculates the feature value (Rank) that is the degree of brightness in one frame of the video signals put into a numerical value based on the entire brightness of the video signals in one frame (FIG. 5: S502).

Then, the drive control signal generation processing module 42 upon receiving the feature value generates a PWM signal according to the feature value based on Expression 1 described above and transmits it to the B/L drive control circuit 31A that is provided to the B/L drive control substrate 31 (FIG. 5: S503).

The B/L drive control circuit 31A upon receiving it drives the backlight 30 according to the PWM signal. That is, the B/L drive control circuit 31A executes controls regarding light-up of the backlight 30 based on the luminance amount shown in the PWM signal (FIG. 5: S504).

Next, actions of each of the circuit blocks regarding gradation conversion processing and the like for complementing the luminance decrease amount of the backlight 30 will be described by referring to FIG. 6.

Figure 6:
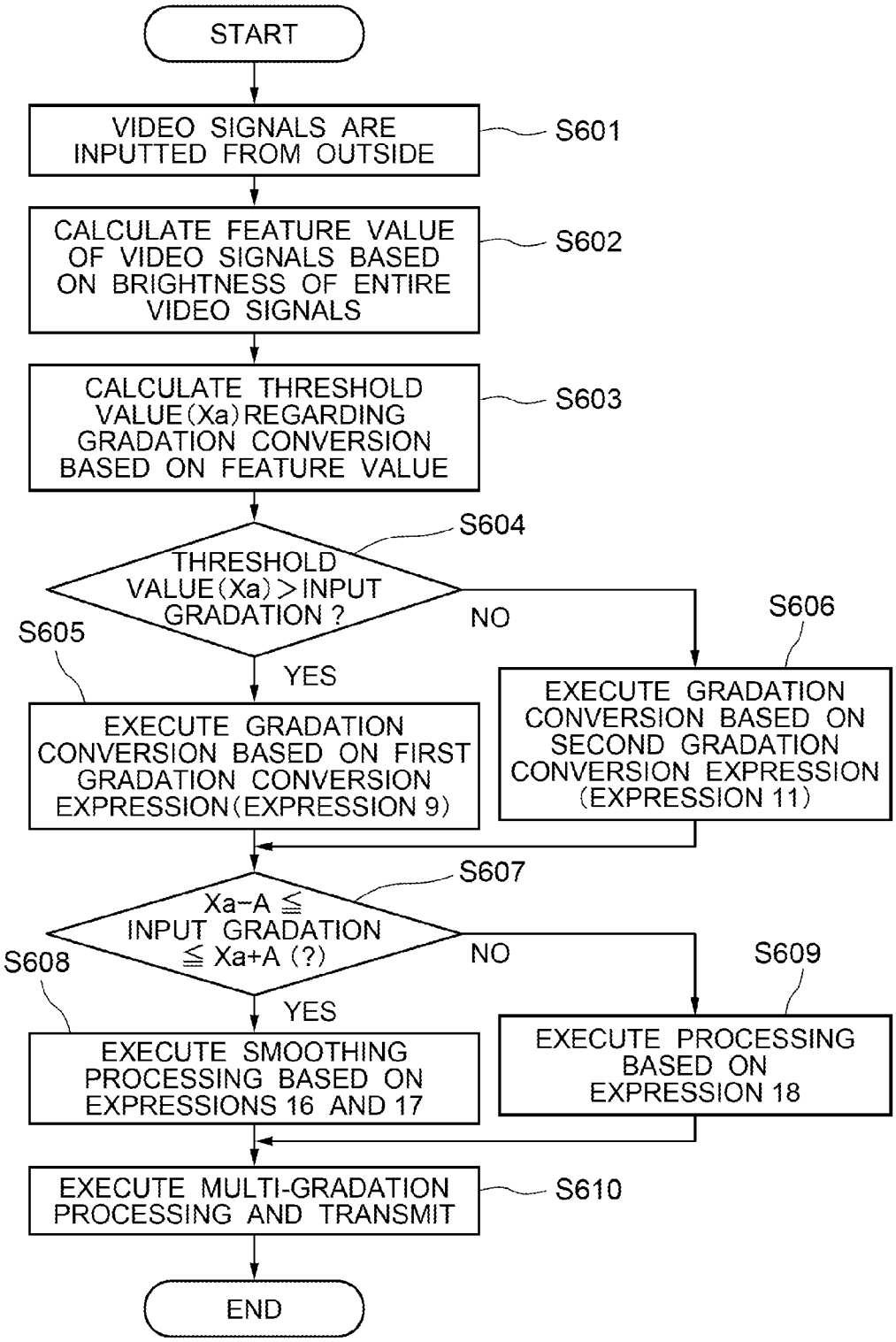
FIG. 6 is a flowchart showing actions of the gradation conversion processing circuit unit disclosed in FIG. 1.

When the video signals are inputted from the video signal supply source 14 (FIG. 6: S601), the feature value/maximum value calculation module 41 upon acquiring the video signals calculates the feature value (Rank) and the maximum value (MAX) in one frame of the video signals based on the entire brightness of the video signals in one frame (FIG. 6: S602).

Then, the gradation conversion threshold value calculation module 61 upon acquiring the feature value and the maximum value calculates the threshold value (Xa) regarding conversion of the gradations based on Expression 4 or Expression 13 described above by using the feature value (FIG. 6: S603).

The gradation conversion module 71 upon receiving the threshold value (Xa) compares the threshold value (Xa) with the value of the gradation of the inputted video signals by the gradation conversion expression selecting function 71A to select the first gradation conversion expression (Expression 9) or the second gradation conversion expression (Expression 11) (FIG. 6: S604).

The gradation conversion expression selecting function 71A in the first exemplary embodiment judges whether or not the threshold value (Xa) satisfies the condition "Xa>input gradation" (FIG. 6: S604).

Here, the gradation conversion expression selecting function 71A when judging that the condition is satisfied selects Expression 9 described above, transmits the video signal (conversion command signal) to which the feature value (Rank) is added to the first gradation converting function 71B (FIG. 6: S604/Yes), and the first gradation converting function 71B accordingly executes gradation conversion based on Expression 9 (FIG. 6: S605).

In the meantime, the gradation conversion expression selecting function 71A when judging that the condition is unsatisfied selects Expression 11 described above, transmits the video signal (conversion command signal) to which the maximum value (MAX) is added to the second gradation converting function 71C (FIG. 6: S604/No), and the second gradation converting function 71C accordingly executes gradation conversion based on Expression 11 (FIG. 6: S606).

Then, the smoothing processing module 81 upon receiving the gradation-converted video signal from either the first gradation converting function 71B or the second gradation converting function 71C judges whether or not the input gradation (converted input gradation) satisfies the smoothing condition "Xa−A≤input gradation≤Xa+A (A is an arbitrary positive number)" (FIG. 6: S607).

When judged to satisfy the smoothing condition (FIG. 6: S607/Yes), the smoothing processing module 81 executes smoothing of the video signals based on Expression 16 and Expression 17 since the input gradation is located in the vicinity of the inflection point (threshold value) (FIG. 6: S608).

In the meantime, when judged that the smoothing condition is unsatisfied (FIG. 6: S607/No), the smoothing processing module 81 executes processing based on Expression 18. That is, in such case, the smoothing processing module 81 gives the received video signal in the original state without changing (adjusting) the gradation thereof to the multi-gradation module 91 (FIG. 6: S609).

Subsequently, the multi-gradation module 91 upon receiving the processed video signals from the smoothing processing module 81 performs multi-gradation processing on the video signals as necessary and transmits the video signals to the display unit driver 21 according to a prescribed transmission format (FIG. 6: S610).

A part of or a whole part of execution contents of each of the steps S501 to S504 (FIG. 5) and each of the steps S601 to S610 (FIG. 6) may be put into programs to achieve a series of each of the control programs by a computer.

Effects and the Like of First Exemplary Embodiment

The video signal processing circuit 12 according to the exemplary embodiment includes the gradation conversion processing unit 51 which performs gradation conversion executed in accordance with the decrease processing of the luminance of the backlight 30 with a small scaled circuit structure more effectively. Thus, it is possible to cut the power consumption greatly particularly under a state where the visibility and the quality of the images based on the video signals containing many high gradation regions are maintained and deterioration in the image quality (a sense of uncomfortableness when seeing the image) is significantly suppressed.

That is, the video signal processing circuit 12 is designed to achieve effective gradation conversion corresponded to the gradation of the video signals with a minimized circuit structure without using an LUT, a memory, or the like (a memory region for temporarily storing input data corresponding to the number of pixels is unnecessary), so that the power consumption regarding each of the control circuits can be decreased. This along with the luminance decrease processing of the backlight 30 makes it possible to decrease the power consumption of the entire video display device 100 greatly.

Especially when the gradation larger than the gradation of the threshold value is inputted, the gradation conversion module 71 according to the first exemplary embodiment performs linear gradation conversion based on the second gradation conversion expression. Therefore, it is possible to suppress deterioration in the image quality such as collapse of the image quality on the high gradation side (side closer to white).

In addition, for the video signals on the low gradation side, the gradation conversion module 71 performs gradation conversion based on the gradation conversion expression which takes the balance between the luminance decrease amount and the gradation conversion amount into consideration to fit to an ideal gamma curve. Therefore, it is possible to acquire a finer image quality compared to the case of the related techniques.

Further, the threshold value calculation expression (Expression 13) derived in the manner described above, the linear function (the second gradation conversion expression: Expression 11) which increases linearly, etc., are formed with the four basic operations of arithmetic. Thus, the gradation conversion threshold value calculation module 61, the second gradation converting function 71C, and the like can be formed with an extremely small scaled circuit structure based thereupon.

As described above, the method for controlling the luminance of the backlight 30 according to the first exemplary embodiment employs the structure (PWM control) with which the video signal processing circuit 12 transmits the information regarding the luminance decrease amount determined by the feature value to the B/L drive control substrate 31 as the PWM signal. However, instead of the control by the PWM signal, the drive control signal generation processing module 42 may be structured to execute the control based on the electric current value.

The first exemplary embodiment is described while assuming that the gradation expression number of the video signals to be inputted is of 8 bits (gradation value is the value between 0 and 255). However, the gradation expression number is not limited only to such case. That is, 6 bits, 10 bits, or the like may be employed as well. Even with such case, it is also possible to effectively suppress deterioration in the image quality and to decrease the power consumption when executing the conversion processing of the video signals with a small circuit scale based on the same principle described above.

As an exemplary advantage according to the invention, it is possible to provide the video signal processing circuit, the video display device, and the video signal processing method, which can achieve suppression of the image quality deterioration and low power consumption with a small circuit scale when performing the conversion processing on the video signals in particular.

Second Exemplary Embodiment

A second exemplary embodiment of a video signal processing circuit and a video display device according to the present invention will be described by referring to FIG. 7 to FIG. 9. Same reference numerals are used for the structural members that are same as those of the above-described first exemplary embodiment.

(Basic Structures)

The gradation conversion processing circuit unit 51 according to the first exemplary embodiment described above employs the circuit structure based on the two divided gradation conversion methods by having a single threshold value as the border thereby to execute the gradation conversion according to the gradation of the video signals to be inputted.

However, the second exemplary embodiment has the feature in respect that it employs a gradation conversion threshold value calculation module 62 having a function of calculating two threshold values instead of the gradation conversion threshold value calculation module 61 and employs a circuit structure based on three gradation conversion methods by having the two threshold values as the borders for the gradation conversion processing circuit unit 52 which includes the gradation conversion threshold value calculation module 62.

Figure 7:
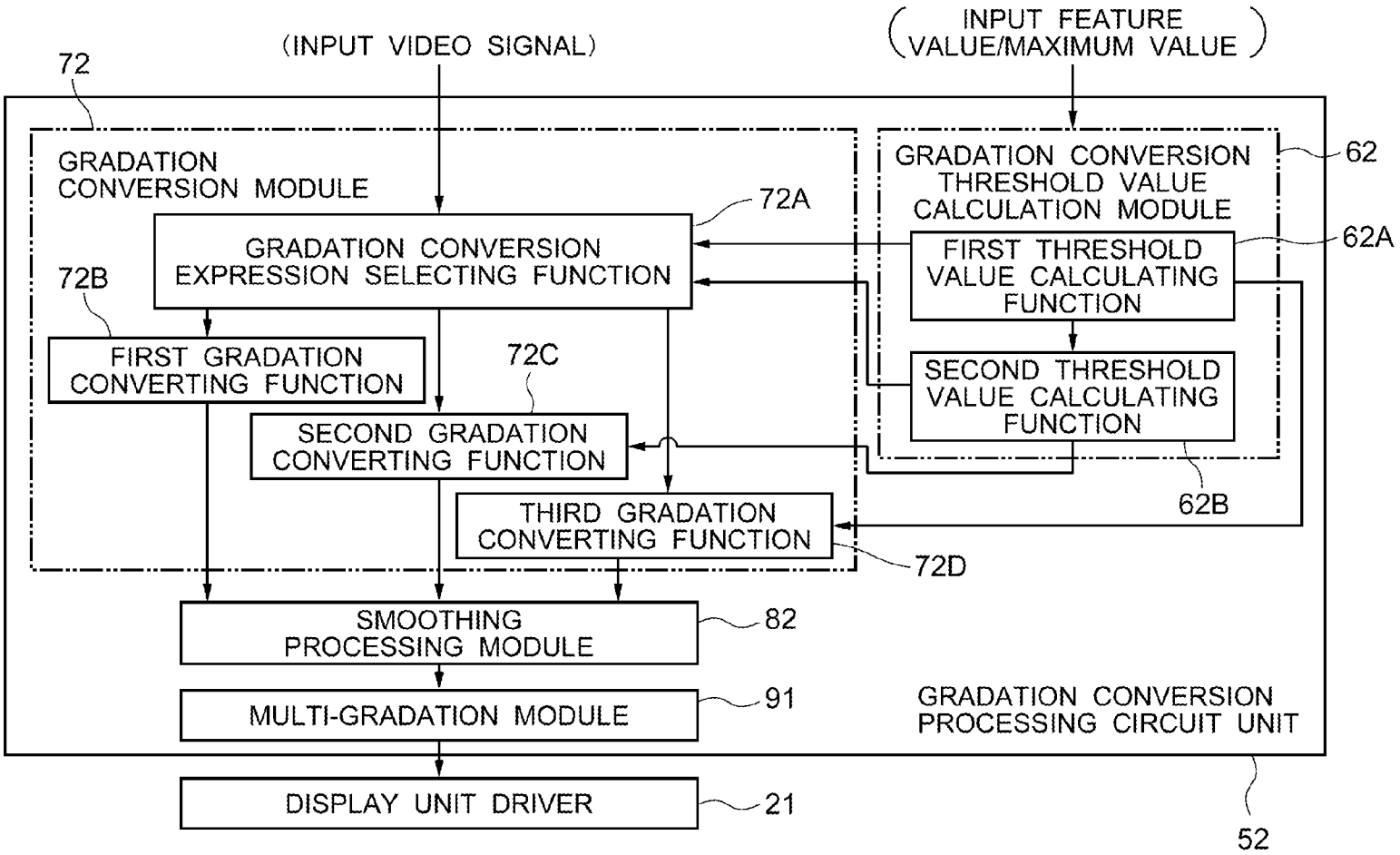
FIG. 7 is a block diagram showing a specific structure of a gradation conversion processing circuit unit which constitutes a video display device according to a second exemplary embodiment of the present invention.

As shown in FIG. 7, the gradation conversion processing circuit unit 52 includes: the gradation conversion threshold value calculation module 62 which calculates a plurality of threshold values regarding conversion of the gradation based on the feature value calculated by the feature value/maximum value calculation module 41; a gradation conversion module 72 which converts the gradation of the video signals supplied from the video signal supply source 14 based on the threshold values calculated by the gradation conversion threshold value calculation module 62; a smoothing processing module (smoothing processing circuit) 82 which performs significant smoothing processing on the video signals (converted video signals) on which the gradation conversion is done by the gradation conversion module 72; and the multi-gradation processing (multi-gradation circuit) 91 which performs processing for securing the resolution of the gamma-converted gradation.

Out of the threshold values calculated by the gradation conversion threshold value calculation module 62 in the second exemplary embodiment, the relatively smaller value (referred to as the first threshold value hereinafter) is structured to be the same value as the threshold value (Xa) of the first exemplary embodiment described above so that it is defined as the first threshold value (Xa) by using the same reference code, and the relatively larger value is defined as the second threshold value (Xb) to provide following explanations (Xa<Xb).

The first threshold value (Xa) and the second threshold value (Xb) are calculated by the gradation conversion threshold value calculation module 62 based on Expression 4 or Expression 14, Expression 15, or the like as in the case of the first exemplary embodiment described above. Further, out of the coefficients $\alpha$ set in advance for calculating the first threshold value (Xa) and the second threshold value (Xb), the coefficient $\alpha$ used when calculating the first threshold value (Xa) is referred to as a conversion coefficient, and the coefficient $\alpha$ used when calculating the second threshold value (Xb) is referred to as a division coefficient.

Figure 8:
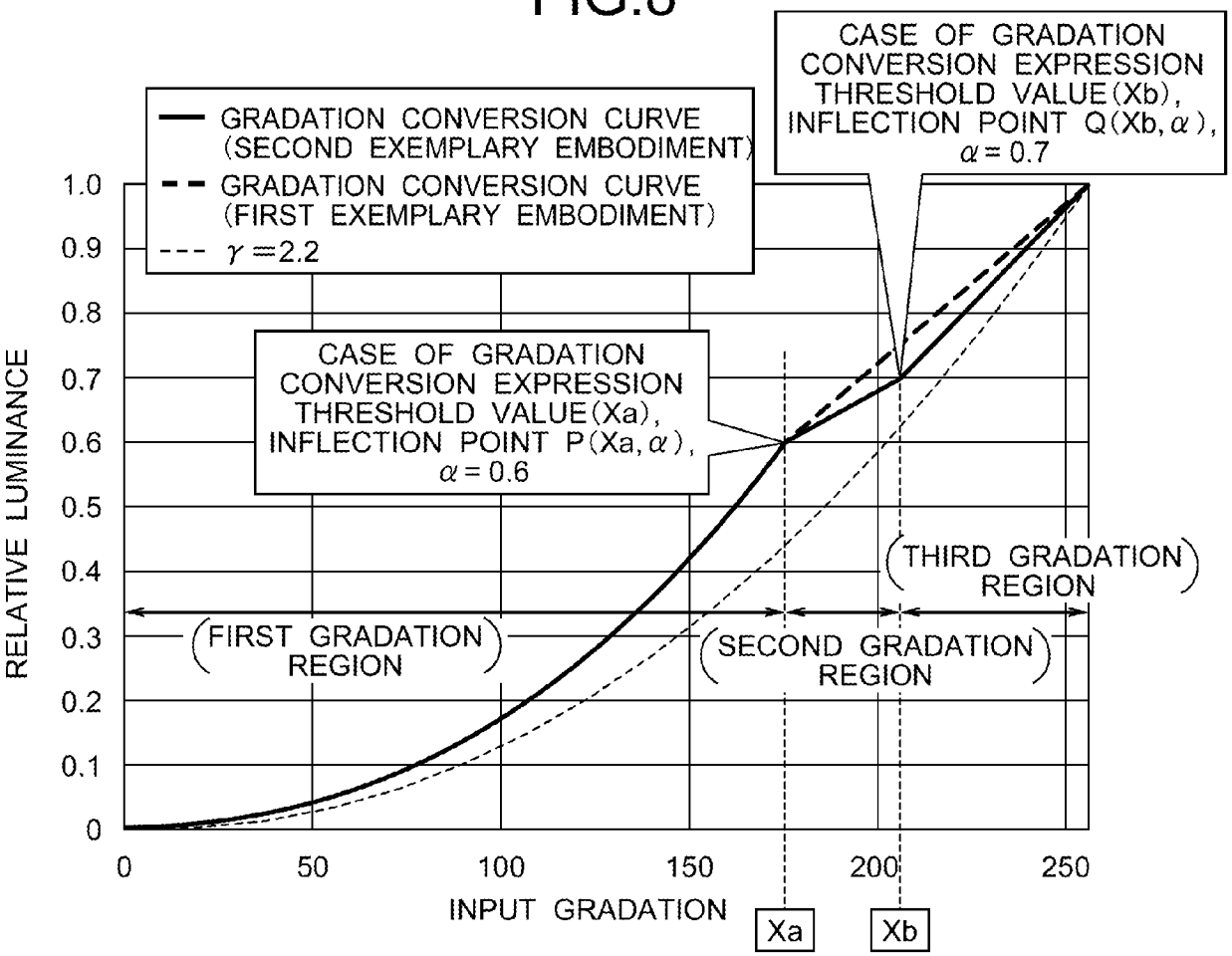
FIG. 8 is a graph which shows a gradation conversion method employed by a video display device according to the second exemplary embodiment of the present invention which includes the gradation conversion processing circuit unit disclosed in FIG. 7.

Referring to FIG. 8, out of the two regions acquired by dividing the entire gradations by taking the first threshold value (Xa) as the border, the gradation conversion module 72 according to the second exemplary embodiment is structured to further divide the region of the gradation of equal to or larger than the first threshold value (Xa) into two, correspond three gradation conversion expressions showing functions of different characteristics from each other to each of those regions, and then to perform gradation conversion on the video signals based on each of the gradation conversion expression.

That is, the gradation conversion module 72 includes a function which divides the gradation of equal to or larger than the first threshold value (Xa) calculated by the gradation conversion threshold value calculation module 61 based on the conversion coefficient into two regions based on the division coefficient and corresponds two gradation conversion expressions showing functions of different slopes from each other to the two regions. Among the two gradation conversion expressions, the gradation conversion expression corresponded to the region of the relatively smaller gradation is a linear function which has a smaller slope than the straight line connected straight from the gradation of the first threshold value (Xa) to the maximum gradation defined by the gradation expression number set in advance, and the gradation conversion expression corresponded to the region of the relatively larger gradation is a linear function which has a larger slope than the straight line connected straight from the gradation of the threshold value to the maximum gradation defined by the gradation expression number set in advance.

(Specific Structures)

As described above, as shown in FIG. 8, in the second exemplary embodiment, gradation conversion for complementing the luminance decrease amount is performed based on Expression 9 described above in the first gradation region as in the case of the first exemplary embodiment. Further, in the second gradation region, the gradation difference is set as more gradual compared to the gradation conversion based on Expression 11 that is employed in the first exemplary embodiment described above. In the third gradation region, the gradation difference is set as steeper compared to the gradation conversion based on Expression 11 that is employed in the first exemplary embodiment described above.

That is, it is the feature point of the second exemplary embodiment to employ the second gradation conversion expression having a smaller slope than Expression 11 described above and the third gradation conversion expression having a larger slope than Expression 11. As is the case of the first exemplary embodiment, the function that increases in a geometric series manner and the linear function that increases linearly are continued in a border section between the first gradation region and the second gradation region.

With such combination, it is possible to perform significant gradation conversion on the video signals containing gradations of the higher gradation region equal to or higher than the second threshold value (Xb) more than the gradations between the first threshold value (Xa) and the second threshold value (Xb), for example. This makes it possible to improve the image quality.

Thus, hereinafter, especially the structural contents regarding the gradation conversion done by the gradation conversion module 72 and processing executed before and after thereof will be described by exemplifying specific numerical values for the coefficients $\alpha$.

The gradation conversion threshold value calculation module 62 includes: a first threshold value calculating function 62A which calculates the first threshold value (Xa) when the value of the coefficient $\alpha$ is set as 0.6; and a second threshold value calculating function 62B which calculates the second threshold value (Xb) when the value of the coefficient $\alpha$ is set as 0.7. The first threshold value calculating function 62A and the second threshold value calculating function 62B are structured to transmit the respectively calculated threshold value (Xa or Xb) to the gradation conversion module 72.

The gradation conversion module 72 includes a gradation conversion expression selecting function 72A which selects one out of a plurality of gradation conversion expressions set in advance (determines the gradation conversion expression used when executing gradation conversion) by comparing the gradation of the inputted video signals and the threshold value calculated by the gradation conversion threshold value calculation module 62 and transmits the video signals according to the selection result. The second exemplary embodiment employs the first gradation conversion expression, the second gradation conversion expression, and the third gradation conversion expression as the above-described gradation conversion expressions.

The gradation conversion module 72 includes: a first gradation converting function 72B which receives the video signals from the gradation conversion expression selecting function 72A and performs gradation conversion (gradation conversion according to the luminance decrease amount) based on the first gradation conversion expression; a second gradation converting function 72C which performs gradation conversion based on the second gradation conversion expression; and a third gradation converting function 72D which performs gradation conversion based on the third gradation conversion expression.

Note here that the gradation conversion threshold value calculation module 62 is structured to give the feature value and the maximum value acquired from the feature value/maximum value calculation module 41 to the gradation conversion expression selecting function 72A of the gradation conversion module 72. The gradation conversion expression selecting function 72A employs a structure which transmits the feature value to the first gradation converting function 72B and the maximum value to the second gradation converting function 72C and the third gradation converting function 72D along with the video signals, respectively.

Further, the gradation conversion threshold value calculating module 62 is structured to transmit the first threshold value (Xa) calculated in the manner described above to the second gradation converting function 72C and to transmit the second threshold value (Xb) calculated in the manner described above to the third gradation converting function 72D.

That is, the gradation conversion module 72 is structured to select the gradation conversion expression used for gradation conversion by the gradation conversion expression selecting function 72A and to convert the gradation of the actually inputted video signals by the first gradation converting function 72B, the second gradation converting function 72C, or the third gradation converting function 72D.

Therefore, it is so structured that the first gradation converting function 72B executes gradation conversion based on the first gradation conversion expression when the input gradation belongs to the first gradation region, the second gradation converting function 72C executes gradation conversion based on the second gradation conversion expression when the input gradation belongs to the second gradation region, and the third gradation converting function 72D executes gradation conversion based on the third gradation conversion expression when the input gradation belongs to the third gradation region.

As shown in FIG. 8, the second exemplary embodiment employing such structure can divide the gradation region into three regions, so that it is possible to execute significant gradation conversion using the three gradation conversion expressions corresponded to each of the regions by the gradation conversion module 72.

In the second exemplary embodiment, each of the gradation conversion expressions also employs the structure that is connected at ends (border parts) located at each border. That is, the graph showing those is connected continuously as shown in FIG. 8 so that there is no omission of gradations.

Each of the graphs shown in FIG. 8 also shows the relation between the input gradations on the lateral axis and the relative luminance degree (relative luminance when the maximum luminance is defined as 1) of the video display unit 20 on the longitudinal axis, and a curve shown with a broken line is a gamma curve showing the gradation characteristic when $\gamma=2.2$. In the meantime, the relation between the input gradations and the relative luminance regarding the gradation conversion method of the second exemplary embodiment can be shown with a curve shown in the region (the first gradation region) from the origin O to the first threshold value (Xa), a straight line shown in the region (the second gradation region) from the threshold value (Xa) to the threshold value (Xb), and a straight line shown in the region (the third gradation region) from the threshold value (Xb) to the maximum gradation value.

The entire graph constituted with the continuously connected function increasing in a geometric series manner and the linear function increasing linearly is referred to as a gradation conversion curve for convenience.

The gradation conversion curve according to the first exemplary embodiment described above is shown with a bold dotted line to clearly show the difference with respect to that of the second exemplary embodiment.

The gradation conversion expression selecting function 72A includes: a first condition judging function (not shown) which judges whether or not the input gradation satisfies the first condition "the first threshold value (Xa)>input gradation"; and a second condition judging function (not shown) which judges whether or not the input gradation satisfies the second condition "the first threshold value (Xa)≤input gradation≤the second threshold value (Xb)".

That is, the gradation conversion expression selecting function 72A is structured to select the first gradation conversion expression and transmit the video signals to which the feature value (Rank) is added to the first gradation converting function 72B when judged that the first condition is satisfied, and to judge whether or not the input gradation satisfies the second condition "the first threshold value (Xa)≤input gradation≤the second threshold value (Xb)" when judged that the first condition is unsatisfied.

Further, the gradation conversion expression selecting function 72A is structured to select the second gradation conversion expression and transmit the video signals to which the maximum value is added to the second gradation converting function 72C when judged that the second condition is satisfied, and to select the third gradation conversion expression and transmit the video signals to which the maximum value is added to the third gradation converting function 72D when judged that the second condition is unsatisfied.

The smoothing processing module 82 employs the structure which executes the smoothing processing in the vicinity of the first threshold value (Xa) where the flection point P (Xa, 0.6) is generated and in the vicinity of the second threshold value (Xb) where the flection point Q (Xb, 0.7) is generated as shown in FIG. 8 as in the case of the smoothing processing module 81 of the first exemplary embodiment.

Therefore, it is possible to suppress deterioration in the image quality more effectively.

The second exemplary embodiment can be structured with the same principle as that of the circuit structure according to the first exemplary embodiment described above except for the structure in which there are two threshold values regarding gradation conversion and there are three gradation conversion expressions accordingly. That is, other structural contents are the same as the structural members of the video display device 100 according to the first exemplary embodiment described above.

(Explanations of Actions)

Actions regarding the gradation conversion processing circuit unit 52 disclosed in FIG. 7 will be described by referring to the flowchart shown in FIG. 9.

Figure 9:
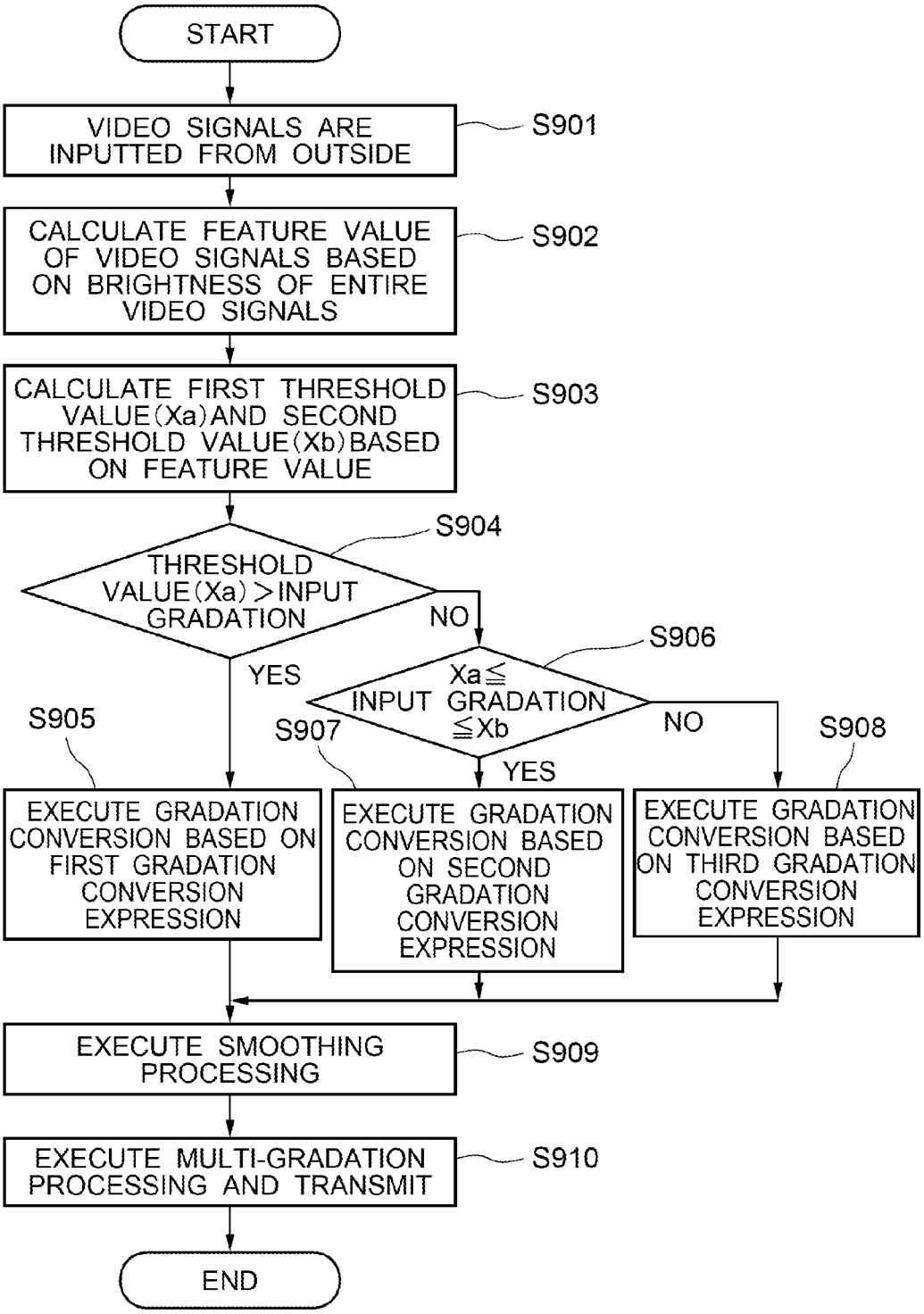
FIG. 9 is a flowchart showing actions of the gradation conversion processing circuit unit disclosed in FIG. 7.

When the video signals are inputted from the video signal supply source 14 (FIG. 9: S901), the feature value/maximum value calculation module 41 upon acquiring the video signals calculates the feature value (Rank) acquired by putting the degree of brightness in one frame of the video signals into a numerical value and the maximum value based on the entire brightness of the video signals in one frame (FIG. 9: S902).

Then, the gradation conversion threshold value calculation module 62 upon acquiring the feature value and the maximum value calculates the first threshold value (Xa) and the second threshold value (Xb) regarding conversion of the gradation based on the feature value (FIG. 9: S903).

The gradation conversion module 72 upon receiving the first threshold value (Xa) and the second threshold value (Xb) compares each of those threshold values (Xa and Xb) with the value of the gradation of the inputted video signals by the gradation conversion expression selecting function 72A to select the first gradation conversion expression, the second gradation conversion expression, or the third gradation conversion expression.

That is, the gradation conversion expression selecting function 72A first judges whether or not the input gradation satisfies the first condition "the first threshold value Xa>input gradation" (FIG. 9: S904).

Here, the gradation conversion expression selecting function 72A when judging that the first condition is satisfied selects the first gradation conversion expression described above, transmits the video signals to which the feature value (Rank) is added to the first gradation converting function 72B (FIG. 9: S904/Yes), and the first gradation converting function 72B accordingly executes gradation conversion based on the first gradation conversion expression (FIG. 9: S905).

In the meantime, the gradation conversion expression selecting function 72A when judging that the first condition is unsatisfied (FIG. 9: S904/No) judges whether or not the input gradation satisfies the second condition "the first threshold value (Xa)≤input gradation≤the second threshold value (Xb)" (FIG. 9: S906).

Here, the gradation conversion expression selecting function 72A when judging that the second condition is satisfied selects the second gradation conversion expression described above, transmits the video signal to which the maximum value is added to the second gradation converting function 72C (FIG. 9: S906/Yes), and the second gradation converting function 72C accordingly executes gradation conversion based on the second gradation conversion expression (FIG. 9: S907).

In the meantime, the gradation conversion expression selecting function 72A when judging that the second condition is unsatisfied selects the third gradation conversion expression described above, transmits the video signal to which the maximum value is added to the third gradation converting function 72D (FIG. 9: S906/No), and the third gradation converting function 72D accordingly executes gradation conversion based on the third gradation conversion expression (FIG. 9: S908).

Then, the smoothing processing module 82 upon receiving the gradation-converted video signals from the first gradation converting function 72B, the second gradation converting function 72C, or the third gradation converting function 72D executes smoothing of the video signals (FIG. 9: S909) by the same processing as the smoothing processing of the first exemplary embodiment described above (FIG. 6: S607 to S609).

Subsequently, the multi-gradation module 91 upon receiving the processed video signals from the smoothing processing module 82 performs multi-gradation processing on the video signals as necessary and transmits the video signals to the display unit driver 21 according to a prescribed transmission format (FIG. 9: S910).

While the contents of the actions are described in order of the numbers applied in FIG. 9 (S901 to S910), the order of actions in the second exemplary embodiment is not necessarily limited to that. Further, a part of or a whole part of execution contents of each of the steps S901 to S910 (FIG. 9) may be put into programs to achieve a series of each of the control programs by a computer.

Effects and the Like of Second Exemplary Embodiment

As described above, the second exemplary embodiment employs the structure with which the gradation conversion threshold value calculation module 62 calculates the two threshold values, and the gradation conversion module 72 divides the gradation of equal to or larger than the first threshold value (Xa) into two and executes gradation conversion by using each of the gradation conversion expressions corresponded to each of the regions. Thus, it is possible to set the gradation conversion expressions flexibly particularly for the region where the slope is desired to be steep, for the region where there is no influence upon the image quality even when the slope is gradual, etc., in the high gradation side region, for example. This makes it possible to perform gradation conversion with still higher versatility.

That is, since the structure with which the three gradation conversion expressions are selectively used according to the gradation in one frame of the video signals is employed, deterioration in the image quality can be suppressed to minimum and the luminance of the backlight 30 can be decreased significantly.

Further, it is also possible to employ the structure with which three or more threshold values are provided as the threshold values regarding gradation conversion.

That is, the gradation conversion module 72 may employ the structure which divides the gradation of equal to or more than the first threshold value (Xa) to a plurality (n+1) of regions based on a plurality (n: an arbitrary natural number) of different division coefficients set in advance and a plurality (n+1) of gradation conversion expressions of different slopes are corresponded to each of the regions.

With such structure the gradation conversion expressions can be corresponded to each of the gradation regions in a more delicate manner, so that it is possible to perform gradation conversion with still higher versatility.

The second exemplary embodiment employs the structure with which the gradation conversion expression selecting function 72A first makes judgment regarding "the first threshold value (Xa)>input gradation: the first condition" and then makes judgment regarding "the first threshold value (Xa)≤input gradation≤the second threshold value (Xb): the second condition" when selecting each of the gradation conversion expressions. However, for example, it is also possible to employ a structure with which a gradation conversion expression is selected by another method which first makes judgment regarding a condition "the second threshold value (Xb)<input gradation" and then makes judgment regarding a condition "the first threshold value (Xa) ≤input gradation≤the second threshold value (Xb)".

Further, the gradation conversion processing regarding the above-described specific structure is described based on the first threshold value (Xa) and the second threshold value (Xb) derived from the conversion coefficient set as 0.6 and the division coefficient set as 0.7 out of the coefficients α regarding calculations of the threshold values. However, the division coefficient regarding the second threshold value (Xb) in particular may be set flexibly within a range of "0.6<division coefficient<1" according to the various video signals and operating environments. Naturally, it is the same for the conversion coefficient regarding the first threshold value (Xa).

Other effects and the like are same as those of the first exemplary embodiment described above. That is, with the video signal processing circuit and the video display device according to the second exemplary embodiment, it is possible to effectively suppress deterioration in the image quality and to achieve low power consumption when executing conversion processing on the video signals with a small circuit scale.

Each of the above-described exemplary embodiments are preferable specific examples of the video signal processing circuit, the video display device, and the video signal processing method, and there may be technically preferable various kinds of limitations set thereupon. However, it is to be noted that the technical scope of the present invention is not limited to those modes unless there is no specific statement mentioned for limiting the scope of the present invention.

New technical contents regarding the above-described exemplary embodiments are summarized as follows. However, the present invention is not necessarily limited thereto.

(Supplementary Note 1)

A video signal processing circuit which analyzes video signals inputted from outside, performs conversion processing for image quality adjustment on the video signals based on a result of analysis, transmits the video signals towards a video display unit, and generates and transmits drive control signals regarding a backlight which lights up the video display unit from a back face, and the video signal processing circuit includes:

a feature value calculation unit which calculates a feature value that is a numerical value showing a degree of brightness of the video signals; and a gradation conversion processing unit which executes conversion processing of gradation of the video signals based on the feature value and a threshold value that is specified by the feature value, wherein the gradation conversion processing unit includes:

a gradation conversion threshold value calculation module which calculates the threshold value based on a threshold value calculation expression that is formed based on the feature value and a conversion coefficient set in advance; and a gradation conversion module which performs gradation conversion based on a linear function that increases linearly on the video signal when the gradation of the video signals is equal to or higher than the threshold value.

(Supplementary Note 2)

The video signal processing circuit as depicted in Supplementary Note 1, wherein the threshold value calculation expression is formed only with the four basic operations of arithmetic (includes a prescribed coefficient).

(Supplementary Note 3)

The video signal processing circuit as depicted in Supplementary Note 1, wherein the threshold value calculation expression is expressed as a numerical expression "Xa=α^(1/2.2)×Rank", where the threshold value is Xa, the feature value is Rank, and the conversion coefficient is α.

(Supplementary Note 4)

The video signal processing circuit as depicted in any one of Supplementary Notes 1 to 3, wherein the linear function that increases linearly is formed only with the four basic operations of arithmetic (includes a prescribed coefficient).

(Supplementary Note 5)

The video signal processing circuit as depicted in any one of Supplementary Notes 1 to 4, which further includes a gradation maximum value calculation unit which calculates a maximum value of the gradation of the video signal, wherein the linear function that increases linearly is expressed with a gradation conversion expression that is formed based on the threshold value and the maximum value.

(Supplementary Note 6)

The video signal processing circuit as depicted in Supplementary Note 5, wherein the gradation conversion expression is expressed as a numerical expression "output gradation=f(n)+{(f(n)−X2.2)/(MAX−Xa)}×(input gradation−MAX)", where the maximum value is MAX, the gradation of the video signals is the input gradation, the maximum gradation (2^n−1: n is a gradation expression number set in advance) is f(n), the conversion coefficient is α, the gradation value when the relative luminance is a on a gamma curve of γ=2.2 is X2.2, the threshold value is Xa, and the gradation of the video signals sent out towards the video display unit is the output gradation.

(Supplementary Note 7)

The video signal processing circuit as depicted in any one of Supplementary Notes 1 to 4, wherein the linear function that increases linearly is expressed with a straight line connected between the gradation of the threshold value and the maximum gradation defined by the gradation number set in advance in a straight manner.

(Supplementary Note 8)

The video signal processing circuit as depicted in any one of Supplementary Notes 1 to 4, wherein the gradation conversion module divides the gradation of equal to or larger than the threshold value into a plurality of regions based on a division coefficient set in advance, and corresponds a plurality of gradation conversion expressions of different slopes to each of those regions as the linear function that increases linearly.

(Supplementary Note 9)

The video signal processing circuit as depicted in any one of Supplementary Notes 1 to 4, wherein:

the gradation conversion module includes a function which divides the gradation of equal to or larger than the threshold value into two regions based on a division coefficient set in advance, and corresponds two gradation conversion expressions of different slopes from each other to the two regions as the linear function that increases linearly;

out of the two gradation conversion expressions, the gradation conversion expression corresponded to the region of relatively smaller gradation is a linear function which has a smaller slope than the straight line connected between the gradation of the threshold value and the maximum gradation defined by a gradation expression number set in advance in a straight manner; and the gradation conversion expression corresponded to the region of relatively larger gradation is a linear function which has a larger slope than the straight line connected between the gradation of the threshold value and the maximum gradation in a straight manner (Supplementary Note 10)

The video signal processing circuit as depicted in any one of Supplementary Notes 1 to 9, wherein:

the gradation conversion module performs gradation conversion based on a function which is formed based on the feature value and increases in a geometric series manner by taking a region of the gradation smaller than the threshold value among the video signals as a target.

(Supplementary Note 11)

The video signal processing circuit as depicted in any one of Supplementary Notes 1 to 9, which further includes a control signal generation processing unit which generates the drive control signals showing a decrease amount of luminance of the backlight based on the feature value and transmits the generated signal towards the backlight, wherein:

the gradation conversion module performs gradation conversion based on a function which is formed based on the decrease amount of the luminance and increases in a geometric series manner to the video signal of a smaller gradation than the threshold value among the video signals.

(Supplementary Note 12)

The video signal processing circuit as depicted in Supplementary Note 10 or 11, wherein the function that increases in a geometric series manner is expressed as a numerical expression "output gradation=(f(n)/Rank)×input gradation", where the gradation of the video signals is the input gradation, the maximum gradation (2^n−1: n is a gradation expression number set in advance) is f(n), the feature value is Rank, and the gradation of the video signals sent out towards the video display unit is the output gradation.

(Supplementary Note 13)

The video signal processing circuit as depicted in Supplementary Note 9, wherein the function that increases in a geometric series manner and the linear function that increases linearly are continued in a border section located at the threshold value.

(Supplementary Note 14)

The video signal processing circuit as depicted in Supplementary Note 10, wherein the function that increases in a geometric series manner and the linear function that increases linearly are continued in a border section located at the threshold value.

(Supplementary Note 15)

The video signal processing circuit as depicted in any one of Supplementary Notes 1 to 9, which further includes a control signal generation processing unit which determines the decrease amount of the luminance of the backlight based on the feature value, generates a drive control signal showing the luminance decrease amount, and transmits it towards the backlight, wherein the gradation conversion module performs gradation conversion for complementing the luminance decrease amount determined by the control signal generation processing unit on the video signals when the gradation of the video signals is smaller than the threshold value.

(Supplementary Note 16)

The video signal processing circuit as depicted in Supplementary Notes 10 to 12, wherein the function that increases in a geometric series manner and the linear function that increases linearly are continued in a border section located at the threshold value.

(Supplementary Note 17)

The video signal processing circuit as depicted in any one of Supplementary Notes 1 to 16, wherein the gradation conversion processing unit further includes a smoothing processing module which: judges whether or not the gradation of the video signals belongs to a smoothing region set in advance near the threshold value; when judged that the gradation belongs to the smoothing region, calculates a smoothing coefficient based on a difference between the threshold value and the gradation of the video signals; and subtracts the smoothing coefficient from the gradation of the video signals.

(Supplementary Note 18)

The video signal processing circuit as depicted in Supplementary Note 17, wherein:

the smoothing region is expressed as a conditional expression "Xa−A≤input gradation≤Xa+A"; and the smoothing processing module calculates the smoothing coefficient according to a numerical expression "{(A−|Xa−input gradation|)^2}×{(MAX−Rank)/(2^n)}", where the maximum value of the gradation of the video signals is MAX, the gradation of the video signals is the input gradation, the threshold value is Xa, the feature value is Rank, A is an arbitrary positive number, and n is a gradation number set in advance.

(Supplementary Note 19)

The video signal processing circuit as depicted in Supplementary Note 17 or 18, wherein when judged that the gradation does not belong to the smoothing region, the smoothing processing module outputs the video signals in an original state towards the video display unit.

(Supplementary Note 20)

The video signal processing circuit as depicted in any one of Supplementary Notes 1 to 19, wherein the gradation conversion threshold value calculation module calculates the threshold value based only on the information included in the video signals inputted from outside (includes a prescribed coefficient).

(Supplementary Note 21)

The video signal processing circuit as depicted in any one of Supplementary Notes 1 to 20, wherein the gradation conversion threshold value calculation module includes an approximation threshold value calculation function which acquires β as an integer by an approximation calculation based on a numerical expression "β=256×α^(1/2.2)", and calculates the threshold value by applying it to a numerical expression "Xa=(β×Rank)/256", where the threshold value is Xa, the feature value is Rank, and the conversion coefficient is α.

(Supplementary Note 22)

The video signal processing circuit as depicted in any one of Supplementary Notes 1 to 21, wherein the conversion coefficient is set in advance as 0.6.

(Supplementary Note 23)

The video signal processing circuit as depicted in any one of Supplementary Notes 1 to 18, wherein the gradation conversion threshold value calculation module applies a numerical expression "Xa=(203×Rank)/256" as the threshold value calculation expression regardless of the conversion coefficient.

(Supplementary Note 24)

A video display device which includes:

a video display unit which displays a video towards outside;

a backlight which lights up the video display unit from a back face; and a video signal processing circuit which analyzes video signals inputted from outside, performs conversion processing for adjusting image quality on the video signals based on a result of analysis, sends out the video signals towards the video display unit, and generates and transmits drive control signals regarding the backlight which lights up the video display unit from the back face; wherein the video signal processing circuit is the video signal processing circuit depicted in any one of Supplementary Notes 1 to 23.

(Supplementary Note 25)

A video signal processing method used in a video signal processing circuit which includes a gradation conversion processing unit which analyzes video signals inputted from outside, performs conversion processing for image quality adjustment on the video signals based on a result of analysis, transmits the video signals towards a video display unit, and a luminance control circuit unit which generates and transmits drive control signals regarding a backlight which lights up the video display unit from a back face, and the method includes:

calculating a feature value that is a numerical value showing a degree of brightness of the video signals by the luminance control circuit unit;

calculating a threshold value regarding conversion of the gradation by the gradation conversion processing unit based on a threshold value calculation expression that is formed based on the feature value and a conversion coefficient set in advance;

judging whether or not the gradation of the video signals is equal to or higher than the threshold value by the gradation conversion processing unit; and executing gradation conversion based on a linear function that increases linearly on the video signals by the gradation conversion processing unit when judged that the gradation of the video signals is equal to or higher than the threshold value.

(Supplementary Note 26)

The video signal processing method as depicted in Supplementary Note 25, which includes:

dividing the gradation of equal to or higher than the threshold value into two regions by the gradation conversion module based on a division coefficient set in advance;

judging whether or not the gradation of the video signals inputted from outside belongs to the region of a relatively smaller gradation out of the two regions;

when judged that the gradation belongs to the region, applying a linear function which has a smaller slope than a straight line connected between the gradation of the threshold value and the maximum gradation defined by a gradation expression number set in advance in a straight manner as a linear function that increases linearly; and when judged that the gradation does not belong to the region, applying a linear function which has a larger slope than the straight line connected between the gradation of the threshold value and the maximum gradation defined as a linear function that increases linearly, wherein contents of each of a series of steps are sequentially executed by the gradation conversion processing unit.

(Supplementary Note 27)

The video signal processing method as depicted in Supplementary Note 25 or 26, which includes:

generating the drive control signal showing the decrease amount of the luminance of the backlight based on the feature value; and transmitting the generated drive control signal towards the backlight, wherein contents of each of a series of steps are sequentially executed after completing calculation of the feature value by the luminance control circuit unit.

(Supplementary Note 28)

The video signal processing method as depicted in any one of Supplementary Notes 25 to 27, wherein when judged that the gradation of the video signals is not equal to or higher than the threshold value at the time of judging whether or not the gradation of the video signals is equal to or higher than the threshold value, the gradation conversion processing unit performs gradation conversion based on a function which is formed based on the feature value and increases in a geometric series manner on the video signals.

(Supplementary Note 29)

The video signal processing method as depicted in any one of Supplementary Notes 25 to 28, which includes:

judging whether or not the gradation of the video signals inputted from outside belongs to a smoothing region set in advance near the threshold value;

calculating a smoothing coefficient based on a difference between the threshold value and the gradation of the video signals when judged that the gradation belongs to the smoothing region; and subtracting the calculated smoothing coefficient from the gradation of the video signals on which the gradation conversion is performed, wherein contents of each of a series of steps are sequentially executed by the gradation conversion processing unit.

(Supplementary Note 30)

A video signal processing program used in a video signal processing circuit which analyzes video signals inputted from outside, performs conversion processing for image quality adjustment on the video signals based on a result of analysis, transmits the video signal towards a video display unit, and generates and transmits drive control signals regarding a backlight which lights up the video display unit from a back face, and the program causes a computer provided in advance to the video signal processing circuit to function as:

a feature value calculation module which calculates a feature value that is a numerical value showing a degree of brightness of the video signals;

a gradation conversion threshold value calculation module which calculates a threshold value regarding conversion of the gradation based on a threshold value calculation expression that is formed based on the feature value and a conversion coefficient set in advance;

a gradation judging module which judges whether or not the gradation of the video signals is equal to or higher than the threshold value; and a linear gradation conversion module which performs gradation conversion based on a linear function that increases linearly on the video signals when judged by the gradation judging module that the gradation is equal to or higher than the threshold value.

(Supplementary Note 31)

A video signal processing program used in a video signal processing circuit which analyzes video signals inputted from outside, performs conversion processing for image quality adjustment on the video signals based on a result of analysis, transmits the video signal towards a video display unit, and generates and transmits drive control signals regarding a backlight which lights up the video display unit from a back face, and the program causes a computer provided in advance to the video signal processing circuit to function as:

a feature value calculation module which calculates a feature value that is a numerical value showing a degree of brightness of the video signals;

a gradation conversion threshold value calculation module which calculates a threshold value regarding conversion of the gradation based on a threshold value calculation expression that is formed based on the feature value and a conversion coefficient set in advance;

a gradation judging module which judges whether or not the gradation of the video signals is equal to or higher than the threshold value;

a region dividing module which divides the gradation of equal to or higher than the threshold value into two regions based on a division coefficient set in advance;

a gradation region judging module which judges whether or not the gradation of the video signals belongs to the region of relatively small gradation out of the two regions when judged by the gradation judging module that the gradation of the video signals is equal to or higher than the threshold value; and a gradual slope linear gradation conversion module which performs, on the video signals, gradation conversion based on a linear function having a smaller slope than a straight line connected between the gradation of the threshold value and the maximum gradation defined by a gradation expression number set in advance in a straight manner when judged by the gradation region judging module that the gradation belongs to that region.

(Supplementary Note 32)

The video signal processing program depicted in Supplementary Note 31, which causes the computer to function as a steep slope linear gradation conversion module which performs, on the video signals, gradation conversion based on a linear function having a larger slope than the straight line connected between the gradation of the threshold value and the maximum gradation in a straight manner when judged by the gradation region judging module that the gradation does not belong to that region.

(Supplementary Note 33)

The video signal processing program depicted in any one of Supplementary Notes 30 to 32, which causes the computer to function as a control signal generation processing module which generates the drive control signal showing the decrease amount of the luminance of the backlight based on the feature value and transmits it towards the backlight.

(Supplementary Note 34)

The video signal processing program depicted in any one of Supplementary Notes 30 to 33, which causes the computer to function as a geometric series gradation conversion module which performs, on the video signals, gradation conversion based on a function which is formed based on the feature value and increases in a geometric series manner when judged by the gradation judging module that the gradation of the video signals is not equal to or higher than the threshold value.

(Supplementary Note 35)

The video signal processing program depicted in any one of Supplementary Notes 30 to 34, which causes the computer to function as:

a threshold value vicinity judging module which judges whether or not the gradation of the video signal inputted from outside belongs to a smoothing region set in advance near the threshold value; and a smoothing processing module which calculates a smoothing coefficient based on a difference between the threshold value and the gradation of the video signals, and subtracts the smoothing coefficient from the gradation of the video signals on which the gradation conversion is performed when judged by the threshold value vicinity judging module that the gradation belongs to that region.

INDUSTRIAL APPLICABILITY

The present invention can be applied to various kinds of display devices such as information processing devices.

What is claimed is:

1. A video signal processing circuit which analyzes video signals inputted from outside, performs conversion processing for image quality adjustment on the video signals based on a result of analysis, transmits the video signals towards a video display unit, and generates and transmits drive control signals regarding a backlight which lights up the video display unit from a back face, the video signal processing circuit comprising:

a gradation conversion processing unit which executes conversion processing of gradation of the video signals based on the feature value and a threshold value that is specified by the feature value, wherein the gradation conversion processing unit comprises:

a gradation conversion threshold value calculation module which calculates the threshold value based on a threshold value calculation expression that is formed based on the feature value and a conversion coefficient set in advance; and a gradation conversion module which performs gradation conversion based on a linear function that increases linearly by taking a region of the gradation equal to or higher than the threshold value among the video signals as a target, wherein the threshold value calculation expression is expressed as a numerical expression "$Xa=\alpha\hat{}(1/2.2)\times Rank$", where the threshold value is Xa, the feature value is Rank, and the conversion coefficient is $\alpha$.

2. The video signal processing circuit as claimed in claim 1, wherein the threshold value calculation expression is formed with the four basic operations of arithmetic.

3. The video signal processing circuit as claimed in claim 1, wherein the linear function that increases linearly is formed with the four basic operations of arithmetic.

4. The video signal processing circuit as claimed in claim 1, further comprising a gradation maximum value calculation unit which calculates a maximum value of the gradation of the video signals, wherein the linear function that increases linearly is expressed with a gradation conversion expression that is formed based on the threshold value and the maximum value.

5. The video signal processing circuit as claimed in claim 1, wherein the linear function that increases linearly is expressed with a straight line connected between the gradation of the threshold value and the maximum gradation defined by the gradation number set in advance in a straight manner.

6. The video signal processing circuit as claimed in claim 1, wherein the gradation conversion module divides the gradation of equal to or larger than the threshold value into a plurality of regions based on a division coefficient set in advance, and corresponds a plurality of gradation conversion expressions of different slopes to each of those regions as the linear function that increases linearly.

7. The video signal processing circuit as claimed in claim 1, wherein:

the gradation conversion module includes a function which divides the gradation of equal to or larger than the threshold value into two regions based on a division coefficient set in advance, and corresponds two gradation conversion expressions of different slopes from each other to the two regions as the linear function that increases linearly;

out of the two gradation conversion expressions, the gradation conversion expression corresponded to the region of relatively smaller gradation is a linear function which has a smaller slope than the straight line connected between the gradation of the threshold value and the maximum gradation defined by a gradation expression number set in advance in a straight manner; and the gradation conversion expression corresponded to the region of relatively larger gradation is a linear function which has a larger slope than the straight line connected between the gradation of the threshold value and the maximum gradation in a straight manner.

8. The video signal processing circuit as claimed in claim 1, wherein:

the gradation conversion module performs gradation conversion based on a function which is formed based on the feature value and increases in a geometric series manner by taking a region of the gradation smaller than the threshold value among the video signals as a target.

9. The video signal processing circuit as claimed in claim 8, wherein the function that increases in a geometric series manner and the linear function that increases linearly are continued in a border section located at the threshold value.

10. The video signal processing circuit as claimed in claim 1, further comprising a control signal generation processing unit which generates the drive control signals showing a decrease amount of luminance of the backlight based on the feature value and transmits the generated signal towards the backlight, wherein:

the gradation conversion module performs gradation conversion based on a function which is formed based on the decrease amount of the luminance and increases in a geometric series manner to the video signal of a smaller gradation than the threshold value among the video signals.

11. The video signal processing circuit as claimed in claim 10, wherein the function that increases in a geometric series manner and the linear function that increases linearly are continued in a border section located at the threshold value.

12. A video display device, comprising:

a video display unit which displays a video towards outside;

a backlight which lights up the video display unit from a back face; and a video signal processing circuit which analyzes video signals inputted from outside, performs conversion processing for adjusting image quality on the video signals based on a result of analysis, sends out the video signals towards the video display unit, and generates and transmits drive control signals regarding the backlight which lights up the video display unit from the back face; wherein the video signal processing circuit is the video signal processing circuit claimed in claim 1.

13. A video signal processing circuit which analyzes video signals inputted from outside, performs conversion processing for image quality adjustment on the video signals based on a result of analysis, transmits the video signals towards a video display unit, and generates and transmits drive control signals regarding a backlight which lights up the video display unit from a back face, the video signal processing circuit comprising:

a feature value calculation unit which calculates a feature value that is a numerical value showing a degree of brightness of the video signals; and a gradation conversion processing unit which executes conversion processing of gradation of the video signals based on the feature value and a threshold value that is specified by the feature value, wherein the gradation conversion processing unit comprises:

a gradation conversion threshold value calculation module which calculates the threshold value based on a threshold value calculation expression that is formed based on the feature value and a conversion coefficient set in advance; and a gradation conversion module which performs gradation conversion based on a linear function that increases linearly by taking a region of the gradation equal to or higher than the threshold value among the video signals as a target;

a gradation maximum value calculation unit which calculates a maximum value of the gradation of the video signals, wherein the linear function that increases linearly is expressed with a gradation conversion expression that is formed based on the threshold value and the maximum value, wherein the gradation conversion expression is expressed as a numerical expression "output gradation=f(n)+{(f(n)−X2.2)/(MAX−Xa)}×(input gradation−MAX)", where the maximum value is MAX, the gradation of the video signals is the input gradation, the maximum gradation (2^n−1: n is a gradation expression number set in advance) is f(n), the conversion coefficient is $\alpha$, the gradation value when the relative luminance is $\alpha$ on a gamma curve of $\gamma$=2.2 is X2.2, the threshold value is Xa, and the gradation of the video signals sent out towards the video display unit is the output gradation.

14. A video signal processing circuit which analyzes video signals inputted from outside, performs conversion processing for image quality adjustment on the video signals based on a result of analysis, transmits the video signals towards a video display unit, and generates and transmits drive control signals regarding a backlight which lights up the video display unit from a back face, the video signal processing circuit comprising:

a feature value calculation unit which calculates a feature value that is a numerical value showing a degree of brightness of the video signals; and a gradation conversion processing unit which executes conversion processing of gradation of the video signals based on the feature value and a threshold value that is specified by the feature value, wherein the gradation conversion processing unit comprises:

a gradation conversion threshold value calculation module which calculates the threshold value based on a threshold value calculation expression that is formed based on the feature value and a conversion coefficient set in advance; and a gradation conversion module which performs gradation conversion based on a linear function that increases linearly by taking a region of the gradation equal to or higher than the threshold value among the video signals as a target, wherein the function that increases in a geometric series manner is expressed as a numerical expression "output gradation=(f(n)/Rank)×input gradation", where the gradation of the video signals is the input gradation, the maximum gradation (2^n−1: n is a gradation expression number set in advance) is f(n), the feature value is Rank, and the gradation of the video signals sent out towards the video display unit is the output gradation.

15. A video signal processing which analyzes video signals inputted from outside, performs conversion processing for image quality adjustment on the video signals based on a result of analysis, transmits the video signals towards a video display unit, and generates and transmits drive control signals regarding a backlight which lights up the video display unit from a back face, the video signal processing circuit comprising:

a feature value calculation unit which calculates a feature value that is a numerical value showing a degree of brightness of the video signals; and a gradation conversion processing unit which executes conversion processing of gradation of the video signals based on the feature value and a threshold value that is specified by the feature value, wherein the gradation conversion processing unit comprises:

a gradation conversion threshold value calculation module which calculates the threshold value based on a threshold value calculation expression that is formed based on the feature value and a conversion coefficient set in advance; and a gradation conversion module which performs gradation conversion based on a linear function that increases linearly by taking a region of the gradation equal to or higher than the threshold value among the video signals as a target; and a control signal generation processing unit which generates the drive control signals showing a decrease amount of luminance of the backlight based on the feature value and transmits the generated signal towards the backlight, wherein:

the gradation conversion module performs gradation conversion based on a function which is formed based on the decrease amount of the luminance and increases in a geometric series manner to the video signal of a smaller gradation than the threshold value among the video signals, wherein the function that increases in a geometric series manner is expressed as a numerical expression "output gradation=(f(n)/Rank)×input gradation", where the gradation of the video signals is the input gradation, the maximum gradation (2^ n−1: n is a gradation expression number set in advance) is f(n), the feature value is Rank, and the gradation of the video signals sent out towards the video display unit is the output gradation.

16. A video signal processing circuit which analyzes video signals inputted from outside, performs conversion processing for image quality adjustment on the video signals based on a result of analysis, transmits the video signals towards a video display unit, and generates and transmits drive control signals regarding a backlight which lights up the video display unit from a back face, the video signal processing circuit comprising:

a feature value calculation unit which calculates a feature value that is a numerical value showing a degree of brightness of the video signals; and a gradation conversion processing unit which executes conversion processing of gradation of the video signals based on the feature value and a threshold value that is specified by the feature value, wherein the gradation conversion processing unit comprises:

a gradation conversion threshold value calculation module which calculates the threshold value based on a threshold value calculation expression that is formed based on the feature value and a conversion coefficient set in advance; and a gradation conversion module which performs gradation conversion based on a linear function that increases linearly by taking a region of the gradation equal to or higher than the threshold value among the video signals as a target, wherein the gradation conversion processing unit further comprises a smoothing processing module which: judges whether or not the gradation of the video signals belongs to a smoothing region set in advance near the threshold value; when judged that the gradation belongs to the smoothing region, calculates a smoothing coefficient based on a difference between the threshold value and the gradation of the video signals; and subtracts the smoothing coefficient from the gradation of the video signals.

17. The video signal processing circuit as claimed in claim 16, wherein:

the smoothing region is expressed as a conditional expression "Xa−A≤input gradation≤Xa+A"; and the smoothing processing module calculates the smoothing coefficient according to a numerical expression "{(A−|Xa−input gradation|)^2}×{(MAX−Rank)/(2^n)}", where the maximum value of the gradation of the video signals is MAX, the gradation of the video signals is the input gradation, the threshold value is Xa, the feature value is Rank, A is an arbitrary positive number, and n is a gradation number set in advance.

18. The video signal processing circuit as claimed in claim 16, wherein when judged that the gradation does not belong to the smoothing region, the smoothing processing module outputs the video signals in an original state towards the video display unit.

19. A video signal processing method used in a video signal processing circuit which comprises a gradation conversion processing unit which analyzes video signals inputted from outside, performs conversion processing for image quality adjustment on the video signals based on a result of analysis, transmits the video signals towards a video display unit, and a luminance control circuit unit which generates and transmits drive control signals regarding a backlight which lights up the video display unit from a back face, the method comprising:

calculating a feature value that is a numerical value showing a degree of brightness of the video signals by the luminance control circuit unit;

calculating a threshold value regarding conversion of the gradation by the gradation conversion processing unit based on a threshold value calculation expression that is formed based on the feature value and a conversion coefficient set in advance;

judging whether or not the gradation of the video signals is equal to or higher than the threshold value by the gradation conversion processing unit;

executing gradation conversion based on a linear function that increases linearly on the video signals by the gradation conversion processing unit when judged that the gradation of the video signals is equal to or higher than the threshold value;

judging whether or not the gradation of the video signals inputted from outside belongs to a smoothing region set in advance near the threshold value;

calculating a smoothing coefficient based on a difference between the threshold value and the gradation of the video signals when judged that the gradation belongs to the smoothing region; and subtracting the calculated smoothing coefficient from the gradation of the video signals on which the gradation conversion is performed, wherein contents of each of a series of the steps are sequentially executed by the gradation conversion processing unit.

* * * * *